US012504206B2

(12) United States Patent
Carter

(10) Patent No.: US 12,504,206 B2
(45) Date of Patent: Dec. 23, 2025

(54) LOW CHARGE SERIES CHILLER AND FREE COOLING

(71) Applicant: Tyco Fire & Security GmbH, Neuhausen am Rheinfall (CH)

(72) Inventor: Thomas P. Carter, Olney, MD (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 69 days.

(21) Appl. No.: 18/236,307

(22) Filed: Aug. 21, 2023

(65) Prior Publication Data

US 2024/0060686 A1 Feb. 22, 2024

Related U.S. Application Data

(60) Provisional application No. 63/399,967, filed on Aug. 22, 2022.

(51) Int. Cl.
*F25B 7/00* (2006.01)
*F25B 5/04* (2006.01)
(Continued)

(52) U.S. Cl.
CPC ..... *F25B 7/00* (2013.01); *F25B 5/04* (2013.01); *F25B 41/22* (2021.01); *F25B 49/022* (2013.01); *F25B 2600/2501* (2013.01)

(58) Field of Classification Search
CPC .... F25B 7/00; F25B 5/04; F25B 41/22; F25B 49/022; F25B 2600/2501; F25B 6/00;
(Continued)

(56) References Cited

U.S. PATENT DOCUMENTS 9,179,580 B2 11/2015 Tozer
2013/0061627 A1* 3/2013 Neumeister ..... B60L 58/27 165/96
(Continued)

FOREIGN PATENT DOCUMENTS

CN 104613577 A * 5/2015 ..... F24F 5/0017
CN 106016858 B * 6/2019
(Continued)

OTHER PUBLICATIONS

International Search Report and Written Opinion for PCT Application No. PCT/US2023/030855, mailed Dec. 8, 2023, 10 pages.

*Primary Examiner* — Kun Kai Ma
(74) *Attorney, Agent, or Firm* — Fletcher Yoder, PC

(57) ABSTRACT

A heating, ventilation, air conditioning, and/or refrigeration (HVAC&R) system includes a process fluid loop configured to receive a process fluid, an internal fluid cooling loop configured to receive a cooling fluid, an air cooled heat exchanger configured to cool the cooling fluid, a vapor compression loop configured to receive a working fluid, and a condenser configured to place the cooling fluid and the working fluid in a first heat exchange relationship. The HVAC&R system also includes a heat exchanger configured to place the cooling fluid and the process fluid in a second heat exchange relationship. The heat exchanger and the condenser are disposed in series relative to a flow of the cooling fluid through the internal fluid cooling loop. The HVAC&R system also includes a pump configured to bias the cooling fluid through the internal fluid cooling loop.

20 Claims, 11 Drawing Sheets

(51) Int. Cl.
*F25B 41/22* (2021.01)
*F25B 49/02* (2006.01)

(58) Field of Classification Search
CPC .. F25B 6/02; F25B 41/20; F25B 49/02; F25B 25/005
See application file for complete search history.

(56) References Cited

U.S. PATENT DOCUMENTS

| | | | | |
|---|---|---|---|---|
| 2015/0176865 | A1* | 6/2015 | McDonnell | H05K 7/20827 62/506 |
| 2016/0066479 | A1* | 3/2016 | Tozer | H05K 7/20763 165/287 |
| 2018/0209675 | A1 | 7/2018 | Ridder | |
| 2022/0186944 | A1 | 6/2022 | Kirkman et al. | |

FOREIGN PATENT DOCUMENTS

| | | | | |
|---|---|---|---|---|
| JP | 2010286126 | A | 12/2010 | |
| WO | WO-2006114983 | A1 * | 11/2006 | B60H 1/32281 |
| WO | WO-2008026791 | A1 * | 3/2008 | F24F 1/022 |
| WO | WO-2014111017 | A1 * | 7/2014 | F25B 25/005 |
| WO | WO-2017056856 | A1 * | 4/2017 | B60H 1/00328 |
| WO | WO-2017158782 | A1 * | 9/2017 | F24H 4/02 |
| WO | WO-2020145527 | A1 * | 7/2020 | B60H 1/00278 |
| WO | 2020247154 | A1 | 12/2020 | |
| WO | 2022212000 | A1 | 3/2022 | |

* cited by examiner

LOW CHARGE SERIES CHILLER AND FREE COOLING

CROSS-REFERENCE TO RELATED APPLICATIONS

This application claims priority from and the benefit of U.S. Provisional Application Ser. No. 63/399,967, entitled "LOW CHARGE SERIES CHILLER AND FREE COOLING," filed Aug. 22, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

This application relates generally to heating, ventilating, air conditioning, and/or refrigeration (HVAC&R) systems employing a vapor compression assembly (or "chiller assembly") and a free cooling assembly.

Certain HVAC&R systems, such as chillers, employ a vapor compression assembly. Vapor compression assemblies utilize a working fluid (e.g., a refrigerant) that changes phases between vapor, liquid, and combinations thereof in response to exposure to different temperatures and pressures within components of the vapor compression assembly. The vapor compression assembly may include an evaporator configured to place the working fluid in a heat exchange relationship with, for example, a conditioning or process fluid (e.g., water), such that the working fluid absorbs heat from the process fluid. The process fluid, cooled by the working fluid, may then be directed towards a conditioned environment, such as a data center, serviced by the HVAC&R system. The process fluid may be passed through downstream equipment, such as air handlers, to condition other fluids, such as air directed into the conditioned environment. A condenser of the vapor compression assembly may be employed to receive the working fluid and condense the working fluid into liquid phase. A compressor of the vapor compression assembly may be employed to bias the working fluid through the vapor compression assembly (e.g., by increasing a pressure of the working fluid).

In certain HVAC&R systems employing a vapor compression assembly, a free cooling assembly may also be employed. For example, a cooling fluid (e.g., water, glycol, or a mixture thereof) associated with the free cooling assembly may be employed to cool various fluids associated with the HVAC&R system, such as the working fluid in the condenser of the vapor compression assembly. Further, a cooling tower (or other cooling source) may be employed in the free cooling assembly to reduce a temperature of the process fluid via ambient air. In this way, the free cooling assembly may leverage a relatively low ambient air temperature for providing cooling and reducing a load on the vapor compression assembly.

In traditional systems, operation of the free cooling assembly may be activated during certain conditions, such as when ambient air temperature is relatively low. When the ambient air temperature is relatively low, the HVAC&R system may be configured to operate, via the free cooling assembly, at an adequate cooling capacity without powering the compressor and/or while reducing a reliance on the compressor (or other components) of the vapor compression assembly. However, in traditional HVAC&R systems utilizing vapor compression and free cooling assemblies, technical constraints may require that reliance on the vapor compression assembly be prioritized over reliance on the free cooling assembly. That is, in traditional HVAC&R systems, cooling may rely heavily on the vapor compression assembly, which requires a relatively large refrigerant charge in the vapor compression assembly and contributes to energy inefficiencies of the HVAC&R system. Accordingly, it is now recognized that improved HVAC&R systems employing vapor compression and free cooling assemblies are desired.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment of the present disclosure, a heating, ventilation, air conditioning, and/or refrigeration (HVAC&R) system includes a process fluid loop configured to receive a process fluid, an internal fluid cooling loop configured to receive a cooling fluid, an air cooled heat exchanger configured to cool the cooling fluid, a vapor compression loop configured to receive a working fluid, and a condenser configured to place the cooling fluid and the working fluid in a first heat exchange relationship. The HVAC&R system also includes a heat exchanger configured to place the cooling fluid and the process fluid in a second heat exchange relationship. The heat exchanger and the condenser are disposed in series relative to a flow of the cooling fluid through the internal fluid cooling loop. The HVAC&R system also includes a pump configured to bias the cooling fluid through the internal fluid cooling loop.

In another embodiment of the present disclosure, a heating, ventilation, air conditioning, and/or refrigeration (HVAC&R) system includes a process fluid loop configured to receive a process fluid, an internal fluid cooling loop configured to receive a cooling fluid, and an air cooled heat exchanger configured to cool the cooling fluid. The HVAC&R system also includes a vapor compression assembly having a vapor compression loop configured to circulate a working fluid through a compressor, a condenser, an evaporator, and an expansion valve, where the condenser is configured to place the working fluid and the cooling fluid in a first heat exchange relationship. The HVAC&R system also includes a heat exchanger configured to place the cooling fluid and the process fluid in a second heat exchange relationship, where the heat exchanger and the condenser are disposed in series relative to a flow of the cooling fluid through the internal fluid cooling loop. The HVAC&R system also includes a pump configured to bias the cooling fluid through the internal fluid cooling loop.

In still another embodiment of the present disclosure, a method of operating a heating, ventilation, air conditioning, and/or refrigeration (HVAC&R) system includes circulating a process fluid through a process fluid loop via at least one first pump, circulating a cooling fluid through an internal fluid cooling loop via at least one second pump, cooling the cooling fluid via an air cooled heat exchanger, and circulating a working fluid through a vapor compression loop via a compressor. The method also includes placing the cooling fluid and the working fluid in a first heat exchange relationship via a condenser corresponding to the vapor compression loop, and placing the cooling fluid and the process fluid in a second heat exchange relationship via a heat exchanger, where the heat exchanger and the condenser are disposed in series relative to a flow of the cooling fluid through the internal fluid cooling loop.

BRIEF DESCRIPTION OF THE DRAWINGS

Various aspects of this disclosure may be better understood upon reading the following detailed description and upon reference to the drawings in which.

DETAILED DESCRIPTION

Figure 1:
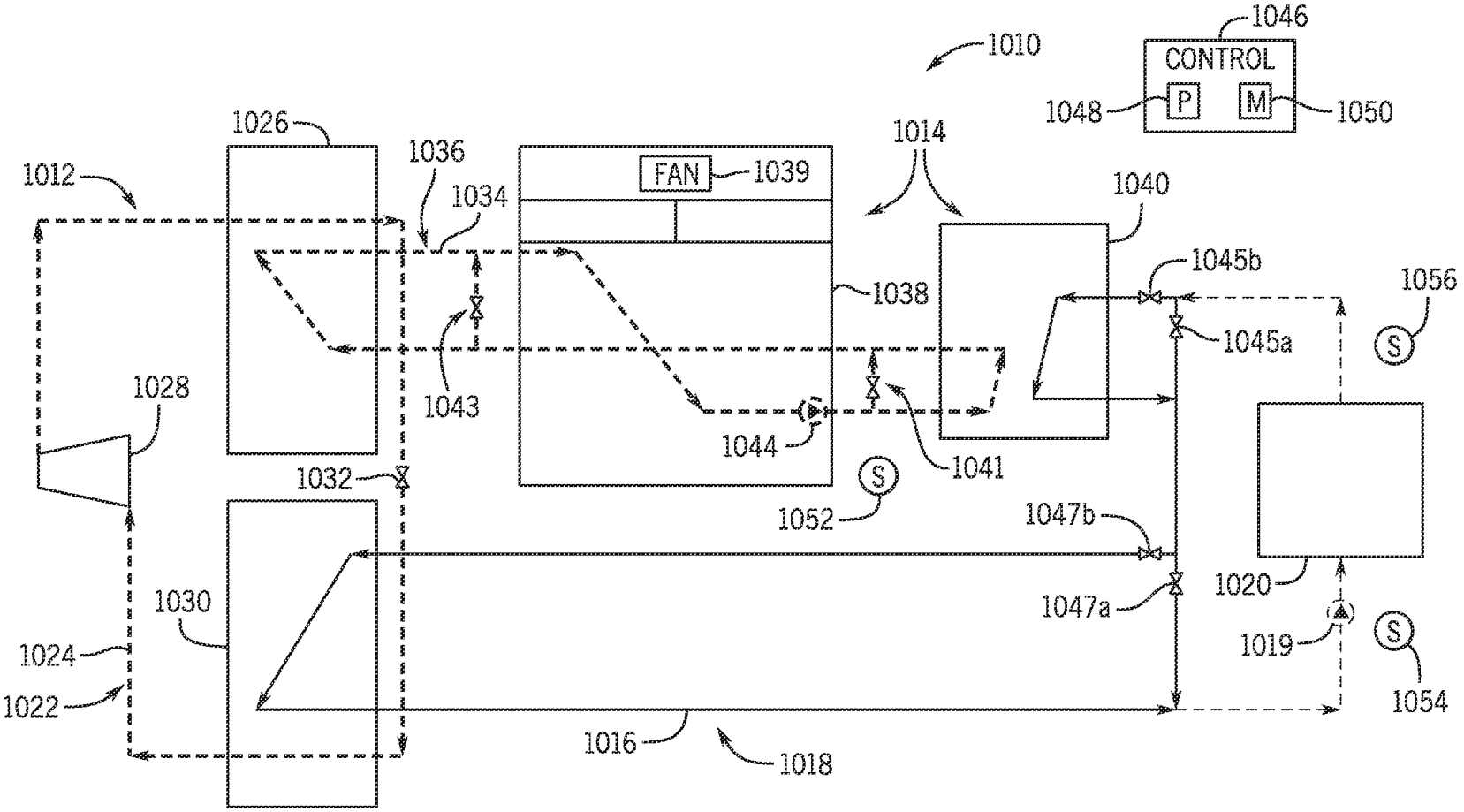
FIG. 1 is a schematic view of a heating, ventilating, air conditioning, and/or refrigeration (HVAC&R) system employing a vapor compression assembly (or chiller assembly), a free cooling assembly, and control features configured to direct a cooling fluid in series through a heat exchanger (e.g., plate frame heat exchanger) of the free cooling assembly and a condenser of the vapor compression assembly, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to a heating, ventilating, air conditioning, and/or refrigeration (HVAC&R) system utilizing a vapor compression assembly and a free cooling assembly. The vapor compression assembly may be employed, for example, in the context of a chiller utilized to cool a conditioning or process fluid during certain conditions. In general, the HVAC&R system is configured to cool the process fluid and route the process fluid towards a load. For example, the process fluid may be cooled by the HVAC&R system and guided to downstream equipment, such as an air handling unit (AHU). The AHU may cool an air flow via the process fluid and distribute the air flow to various spaces (e.g., rooms, data centers) conditioned by the HVAC&R system. Alternatively, the process fluid may be employed to directly cool a load, such as equipment of the data center, in a liquid immersion or other direct liquid cooling application.

The vapor compression assembly may include a vapor compression loop (referred to in certain instances of the present disclosure as a working fluid loop) that circulates a working fluid (e.g., refrigerant) through an evaporator, a condenser, and a compressor. The compressor may operate to compress (e.g., increase a pressure of) the working fluid in certain conditions, thereby biasing the working fluid through the vapor compression loop. The evaporator may be employed to cool the process fluid by absorbing heat from the process fluid into the working fluid in certain conditions. The condenser may be employed to remove heat from the working fluid, for example, via a cooling fluid of an internal fluid cooling loop associated with the free cooling assembly in certain conditions. In this way, the condenser may be considered a part of the internal fluid cooling loop while the cooling fluid of the internal fluid cooling loop is present at the condenser.

The free cooling assembly may include an air cooled heat exchanger disposed in an external environment, a pump, and a plate frame heat exchanger that provides liquid-to-liquid cooling. For example, the plate frame heat exchanger may be employed to cool the process fluid via the cooling fluid of the free cooling assembly in certain conditions. The air cooled heat exchanger, which may include a single fan (e.g., a single fan serving a V-shaped coil assembly), may be employed to reduce a temperature of the cooling fluid prior to the cooling fluid being directed towards the plate frame heat exchanger and/or the condenser of the vapor compression assembly. Further, a first bypass valve may be employed to bypass a portion of the cooling fluid around the plate frame heat exchanger in certain conditions (e.g., via actuation of the first bypass valve to an open position), and a second bypass valve may be employed to bypass a portion of the cooling fluid around the condenser in certain conditions (e.g., via actuation of the second bypass valve to an open position).

Positions of the first bypass valve and the second bypass valve may be controlled by a controller based on ambient conditions (e.g., ambient dry bulb temperature) and/or operating conditions of the HVAC&R system (e.g., a return temperature or target return temperature of the process fluid from the load, a supply temperature or target supply temperature of the process fluid to the load, an operating load, etc.). Based on one or more of these inputs, the controller may actuate the first and/or second bypass valves to the preferred valve setting, described in greater detail with reference to the drawings. Additionally, a setting of the pump may be controlled by the controller based on various conditions, such as the above-described ambient conditions and/or operating conditions. In this way, a flow rate of the cooling fluid may be controlled to correspond to pre-defined conditions, provide adequate cooling, and/or minimize a reliance on the vapor compression assembly relative to traditional embodiments. In general, the pump may be configured to bias the cooling fluid to the plate frame heat exchanger and then to the condenser in series. Of course, in certain conditions and as described above, some of the cooling fluid may bypass the plate frame heat exchanger (e.g., via the first bypass valve) or the condenser (e.g., via the second bypass valve). For example, at relatively high temperatures and/or relatively high operating loads, the cooling fluid may bypass the plate frame heat exchanger (e.g., via the first bypass valve) while the system relies exclusively on the vapor compression assembly. Further, at relatively low temperatures and/or relatively low operating loads, some of the cooling fluid may bypass the condenser (e.g., via the second bypass valve) while the system relies exclusively on the free cooling assembly.

Further to the points above, a setting of the compressor of the vapor compression system, which operates to increase a pressure of the working fluid in the vapor compression loop, may be controlled by the controller to correspond with the above-described first and second bypass valve settings, to correspond with the pump setting, and/or to correspond to the above-described ambient and/or operating conditions. Further still to the points above, the fan of the air cooled heat exchanger may be controlled to a setting to provide sufficient cooling to the cooling fluid of the free cooling assembly (e.g., based on the above-described ambient and/or operating conditions). Other control aspects are also possible and described in detail with reference to the drawings.

By employing the above-described features, the HVAC&R system may be capable of providing cooling to a conditioned space, such as a data center, via substantial reliance on the free cooling assembly and a relatively low reliance on the vapor compression assembly, thereby providing adequate cooling while improving energy efficiency and reducing a refrigerant charge of the vapor compression assembly relative to traditional embodiments. As an example, for an HVAC&R system having a system design load capacity of 500 refrigeration tons in which an operating load is 100% of the system design load capacity, a supply temperature of the process fluid at 70 degrees Fahrenheit may be enabled via complete reliance on the free cooling assembly (e.g., with the compressor of the vapor compression assembly turned off) at least when the ambient temperature is approximately 62 degrees Fahrenheit or less. Further, if the operating load is reduced, the supply temperature of the process fluid at 70 degrees Fahrenheit may be enabled via complete reliance on the free cooling assembly when the ambient temperature is substantially higher than 62 degrees Fahrenheit. As an example, when the operating load is 50% of the system design load capacity, the HVAC&R system may be capable of providing adequate cooling as described above via complete reliance on the free cooling assembly (e.g., with the compressor of the vapor compression assembly turned off) when ambient temperature is approximately 66 degrees Fahrenheit or less. Of course, at even higher ambient temperatures, the HVAC&R system may rely heavily on the free cooling assembly to provide at least partial cooling of the process fluid.

Further still to the points above, presently disclosed embodiments may avoid exclusive reliance on the vapor compression assembly (i.e., without any reliance on the free cooling assembly) at more extreme conditions than traditional embodiments. For example, for an HVAC&R system having a system design load capacity of 500 refrigeration tons in which an operating load is 100% of the system design load capacity, a supply temperature of the process fluid at 70 degrees Fahrenheit may be enabled via at least partial reliance on the free cooling assembly in ambient dry bulb temperatures of up to 91 degrees Fahrenheit. Further, if the operating load is reduced to 50% and all else is equal to the above, a supply temperature of the process fluid at 70 degrees Fahrenheit may be enabled via at least partial reliance on the free cooling assembly in ambient dry bulb temperatures of up to 95 degrees Fahrenheit. Other examples are provided with reference to the drawings.

In general, presently disclosed systems and methods enable cooling with a heavier reliance on free cooling and a reduced reliance on vapor compression compared to traditional embodiments. In doing so, a necessary refrigerant charge of the vapor compression assembly is reduced relative to traditional embodiments due at least in part to the use of compact condensers versus larger volume air cooled condensers, and an energy efficiency of the HVAC&R system is improved relative to traditional embodiments due at least in part to the lower air resistance of a single air-cooled heat exchanger and intelligent speed control of the air-cooled heat exchanger fan and the cooling fluid pump. These and other features are described in detail below with reference to the drawings.

FIG. 1 is a schematic view of an embodiment of an HVAC&R system 1010 employing a vapor compression assembly 1012 (or chiller assembly), a free cooling assembly 1014, and control features configured to modulate a reliance on the vapor compression assembly 1012 and the free cooling assembly 1014. In general, the vapor compression assembly 1012 and the free cooling assembly 1014 are configured to cool a process fluid 1016 (e.g., water, glycol, a water-glycol mixture, a dielectric fluid in liquid immersion applications, etc.) corresponding to a process fluid loop 1018 of a process fluid assembly, where the process fluid 1016 is biased through the process fluid loop 1018 via a pump 1019. As shown, the process fluid loop 1018 may guide the process fluid 1016 to a load 1020 (e.g., a condition space and/or data center) for cooling the load 1020. Depending on ambient conditions and/or operating conditions of the HVAC&R system 1010, a reliance on the vapor compression assembly 1012 and/or a reliance on the free cooling assembly 1014 for cooling the process fluid 1016 may be modulated to ensure adequate cooling and reduce energy consumption of the HVAC&R system 1010 relative to traditional embodiments. These and other features are described in detail below with reference to FIG. 1.

The vapor compression assembly 1012 may include a vapor compression loop 1022 (referred to in certain instances of the present disclosure as a working fluid loop) that routes a working fluid 1024 (e.g., a refrigerant, such as R-123, R-514A, R-1224yd, R-1233zd, R-134a, R-1234ze, R-1234yf, R-1311, R-32, R-410A, or others) through various components of the vapor compression assembly 1012. For example, the vapor compression loop 1022 may route the working fluid 1024 through a compressor 1028, a condenser 1026, an expansion valve 1032, and an evaporator 1030 of the vapor compression assembly 1012. The compressor 1028 may operate to bias the working fluid 1024 through the vapor compression loop 1022 (e.g., by increasing a pressure of the working fluid 1024) in certain conditions. The evaporator 1030 may operate to cool the process fluid 1016 of the process fluid loop 1018 in certain conditions. The expansion valve 1032 may operate to reduce a pressure of the working fluid 1024 between the condenser 1026 and the evaporator 1030. The condenser 1026 may operate to remove heat from the working fluid 1024 in certain conditions via fluid-to-liquid cooling in which heat is transferred from the working fluid 1024 to a cooling fluid 1034 (e.g., water, glycol, a water-glycol mixture, etc.) corresponding to an internal fluid cooling loop 1036 of the free cooling assembly 1014. In this way, the condenser 1026 may be considered a part of the internal fluid cooling loop 1036 while the cooling fluid 1034 of the internal fluid cooling loop 1036 is circulating through the condenser 1026.

As previously described, in certain ambient conditions and/or operating conditions of the HVAC&R system 1010, the free cooling assembly 1014 may be employed to reduce a reliance on the vapor compression assembly 1012 for cooling the process fluid 1016 of the process fluid loop 1018. For example, as a reliance on the free cooling assembly 1014 is increased in response to certain conditions, a reliance on the compressor 1028 of the vapor compression assembly 1012 may be reduced. In certain conditions, the compressor 1028 may be entirely disconnected or otherwise turned off while the HVAC&R system 1010 relies only on the free cooling assembly 1014 to provide cooling to the process fluid 1016. Additionally or alternatively, the HVAC&R system 1010 may rely on both the free cooling assembly 1014 and the vapor compression assembly 1012 in certain conditions with the compressor 1028 controlled to a relatively low setting, thereby improving energy efficiency while ensuring adequate cooling of the process fluid 1016. Aspects of the free cooling assembly 1014 and control of the HVAC&R system 1010 to modulate reliance on the vapor compression assembly 1012 and/or the free cooling assembly 1014 are described in detail below.

In the illustrated embodiment, the free cooling assembly 1014 includes the internal fluid cooling loop 1036 configured to route the cooling fluid 1034 through various components of the HVAC&R system 1010, including the condenser 1026 of the vapor compression assembly 1012, an air cooled heat exchanger 1038 (e.g., having a fan 1039) of the free cooling assembly 1014, and a plate frame heat exchanger 1040 of the free cooling assembly 1014. In general, the air cooled heat exchanger 1038 is configured to cool the cooling fluid 1034 (e.g., via the fan 1039) prior to delivery of the cooling fluid 1034 to the plate frame heat exchanger 1040 of the free cooling assembly 1014 and/or the condenser 1026 of the vapor compression assembly 1012. In some embodiments, the air cooled heat exchanger 1038 may include only one instance of the fan 1039 configured to cool the cooing fluid 1034 prior to delivery of the cooling fluid 1034 to the plate frame heat exchanger 1040 and/or the condenser 1026.

When the cooling fluid 1034 is circulating through the condenser 1026, the cooling fluid 1034 absorbs heat from the working fluid 1024 corresponding to the vapor compression assembly 1012, causing the working fluid 1024 to condense prior to delivery of the working fluid 1024 to the expansion valve 1032. When the cooling fluid 1034 is circulating through the plate frame heat exchanger 1040, the cooling fluid 1034 absorbs heat from the process fluid 1016 corresponding to the process fluid loop 1018.

As shown, the cooling fluid 1034 may be routed to the plate frame heat exchanger 1040 and the condenser 1026 in series. That is, the plate frame heat exchanger 1040 and the condenser 1026 may be in series relative to a flow path defined by the internal fluid cooling loop 1036. A pump 1044 may be employed to bias the cooling fluid 1034 through the internal fluid cooling loop 1036. However, aspects of the free cooling assembly 1014 may be controlled to bypass a portion of the cooling fluid 1034 from the plate frame heat exchanger 1040 in certain conditions, bypass a portion of the cooling fluid 1034 from the condenser 1026 in other conditions, or enable the cooling fluid 1034 to flow (e.g., in series) to the plate frame heat exchanger 1040 and the condenser 1026 in still other conditions.

For example, a first bypass valve 1041 is disposed on the internal fluid cooling loop 1036 adjacent the plate frame heat exchanger 1040. When the first bypass valve 1041 is in a closed position, as shown, the internal fluid cooling loop 1036 guides the cooling fluid 1034 to the plate frame heat exchanger 1040. When the first bypass valve 1041 is in an open position, a portion of the cooling fluid 1034 may bypass the plate frame heat exchanger 1040, reducing load on the pump 1044. Further, a second bypass valve 1043 is disposed on the internal fluid cooling loop 1036 adjacent the condenser 1026. When the second bypass valve 1043 is in a closed position, as shown, the internal fluid cooling loop 1036 guides the cooling fluid 1034 to the condenser 1026. When the second bypass valve 1043 is in an open position, a portion of the cooling fluid 1034 may bypass the condenser 1026, reducing load on the pump 1044.

A pump setting of the pump 1044, a position of the first bypass valve 1041, and a position of the second bypass valve 1043 may be controlled based on ambient conditions and/or operating conditions of the HVAC&R system 1010. Other bypass or flow diverting valves may also be employed, such as valves employed on the process fluid loop 1018. For example, as shown, a first pair of valves 1045*a*, 1045*b* is disposed in the process fluid loop 1018 adjacent to the plate frame heat exchanger 1040. The first pair of valves 1045*a*, 1045*b* may be controlled to enable or disable the process fluid 1016 to flow to the plate frame heat exchanger. As shown, valve 1045*a* is closed and valve 1045*b* is open, enabling a flow of the process fluid 1016 to the plate frame heat exchanger 1040. In other conditions, valve 1045*a* may be open and valve 1045*b* may be closed, disabling a flow of the process fluid 1016 to the plate frame heat exchanger 1040. In another embodiment in accordance with the present disclosure, the pair of valves 1045*a*, 1045*b* may be replaced with a single valve (e.g., three-way valve).

The illustrated embodiment also includes a second pair of valves 1047*a*, 1047*b* disposed downstream from the first pair of valves 1045*a*, 1045*b*. The second pair of valves 1047*a*, 1047*b* may be controlled to enable or disable a flow of the process fluid 1016 to the evaporator 1030 of the vapor compression assembly 1012. In the illustrated embodiment, valve 1047*b* is open and valve 1047*a* is closed, thereby enabling a flow of the process fluid 1016 to the evaporator 1030. In other conditions, valve 1047*a* may be open and valve 1047*b* may be closed, thereby disabling a flow of the process fluid 1016 to the evaporator 1030. In another embodiment in accordance with the present disclosure, the pair of valves 1047*a*, 1047*b* may be replaced with a single valve (e.g., three-way valve).

Various components and corresponding controls are described above. In some embodiments, these and/or other components may be controlled based on ambient conditions and/or operating conditions of the HVAC&R system 1010. For example, a controller 1046 of the HVAC&R system 1010 includes processing circuitry 1048 and memory circuitry 1050 having instructions stored thereon that, when executed by the processing circuitry 1048, cause the processing circuitry 1048 to perform various functions. It should be noted that, for brevity, only one instance of the controller 1046 is shown in the illustrated embodiment. However, it should be noted that multiple controllers (including dedicated processing and/or memory circuitry) may be employed to implement the control features described in the present disclosure.

The controller 1046 may receive one or more inputs indicative of various ambient conditions and/or operating conditions of the HVAC&R system 1010. For example, the controller 1046 may receive, from a first sensor 1052, a first input indicative of an ambient temperature (e.g., proximate the air cooled heat exchanger 1038), such as an ambient dry bulb temperature. Additionally or alternatively, the controller 1046 may receive, from a second sensor 1054, a second input indicative of a supply temperature of the process fluid 1016 directed to the load 1020. Additionally or alternatively, the controller 1046 may receive, from a third sensor 1056, a third input indicative of a return temperature of the process fluid 1016 returned from the load 1020. In some embodiments, the controller 1046 may employ a target supply temperature of the process fluid 1016 directed to the load 1020 and/or a target return temperature of the process fluid 1016 returned from the load 1020 (e.g., in addition to, or in the alternate of, the detected temperatures). Additionally or alternatively, the controller 1046 may receive (or otherwise determine) a fourth input indicative of an operating load corresponding to the HVAC&R system 1010 and/or the load 1020. Indeed, while the HVAC&R system 1010 may include a system design load capacity, a cooling demand of the load 1020 at certain operating intervals may correspond to an operating load that is less than the system design load capacity. The fourth input indicative of the operating load may be, for example, a percentage of the system design load capacity.

In response to at least one of the above-described inputs (e.g., the ambient dry bulb temperature, the supply temperature and/or target supply temperature of the process fluid 1016, the return temperature and/or target return temperature of the process fluid 1016, the operating load, etc.), the controller 1046 may control various components of the HVAC&R system 1010 to ensure adequate cooling of the load 1020 while reducing energy consumption. In particular, the controller 1046 may control, based on the ambient and/or operating conditions, the first bypass valve 1041, the second bypass valve 1043, the first pair of valves 1045*a*, 1045*b*, the second pair of valves 1047*a*, 1047*b*, the speed setting of the pump 1044, the speed setting of the pump 1019, the fan speed setting of the fan 1039, the compressor capacity setting of the compressor 1028, or any combination thereof. In some embodiments, certain of the above-described components are merely controlled in a manner that corresponds to control of certain other of the above-described components. In general, presently disclosed systems and methods are configured to enable the HVAC&R system 1010 to provide adequate cooling to the process fluid 1016 while relying heavily on the free cooling assembly 1014, thereby improving efficiency of the HVAC&R system 1010 relative to traditional embodiments.

Figure 2:
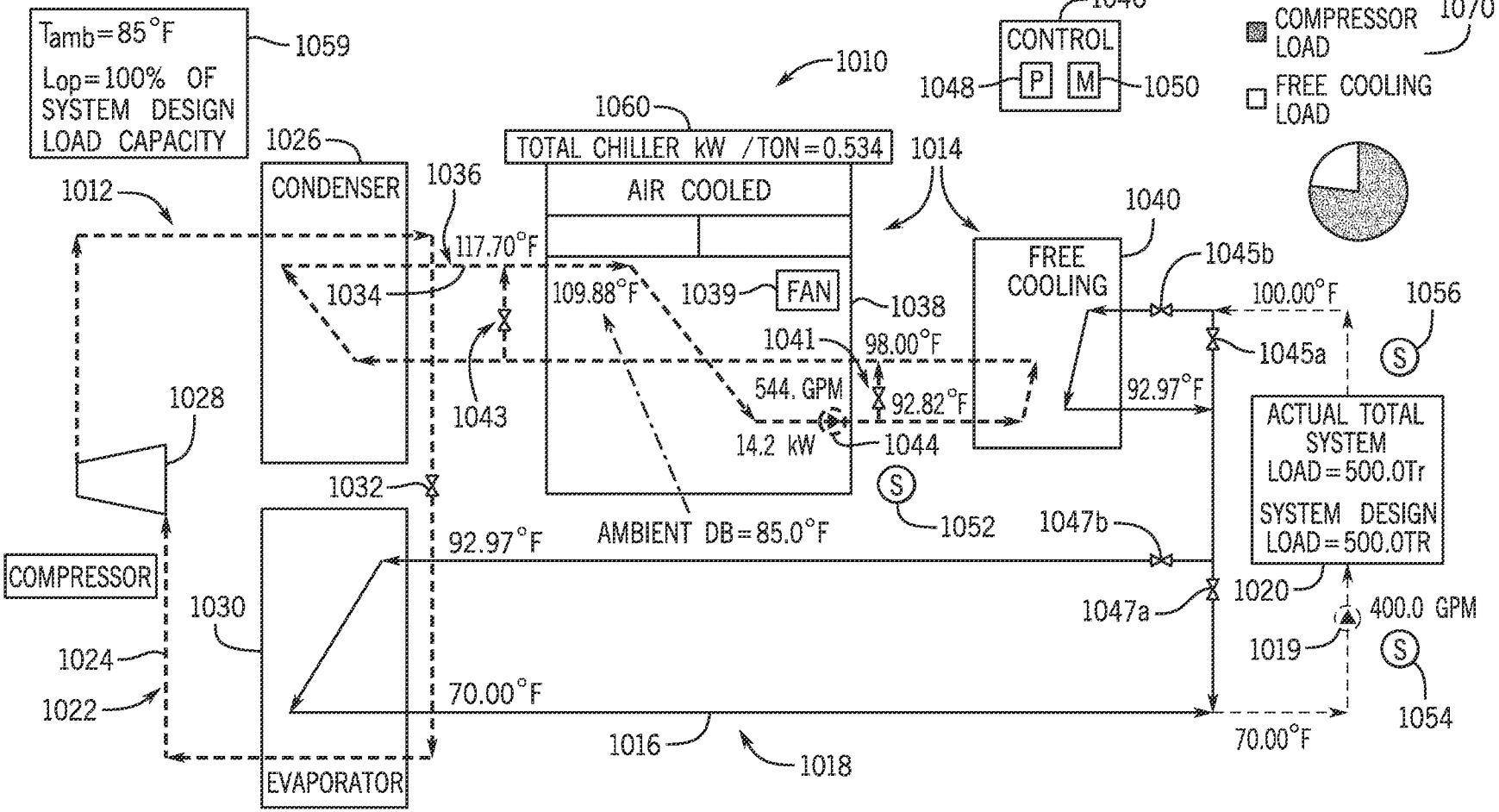
FIG. 2 is a schematic view of the HVAC&R system in FIG. 1 where ambient dry bulb temperature is 85 degrees Fahrenheit and an operating load is 100% of system design load capacity, in accordance with an aspect of the present disclosure.
Figure 3:
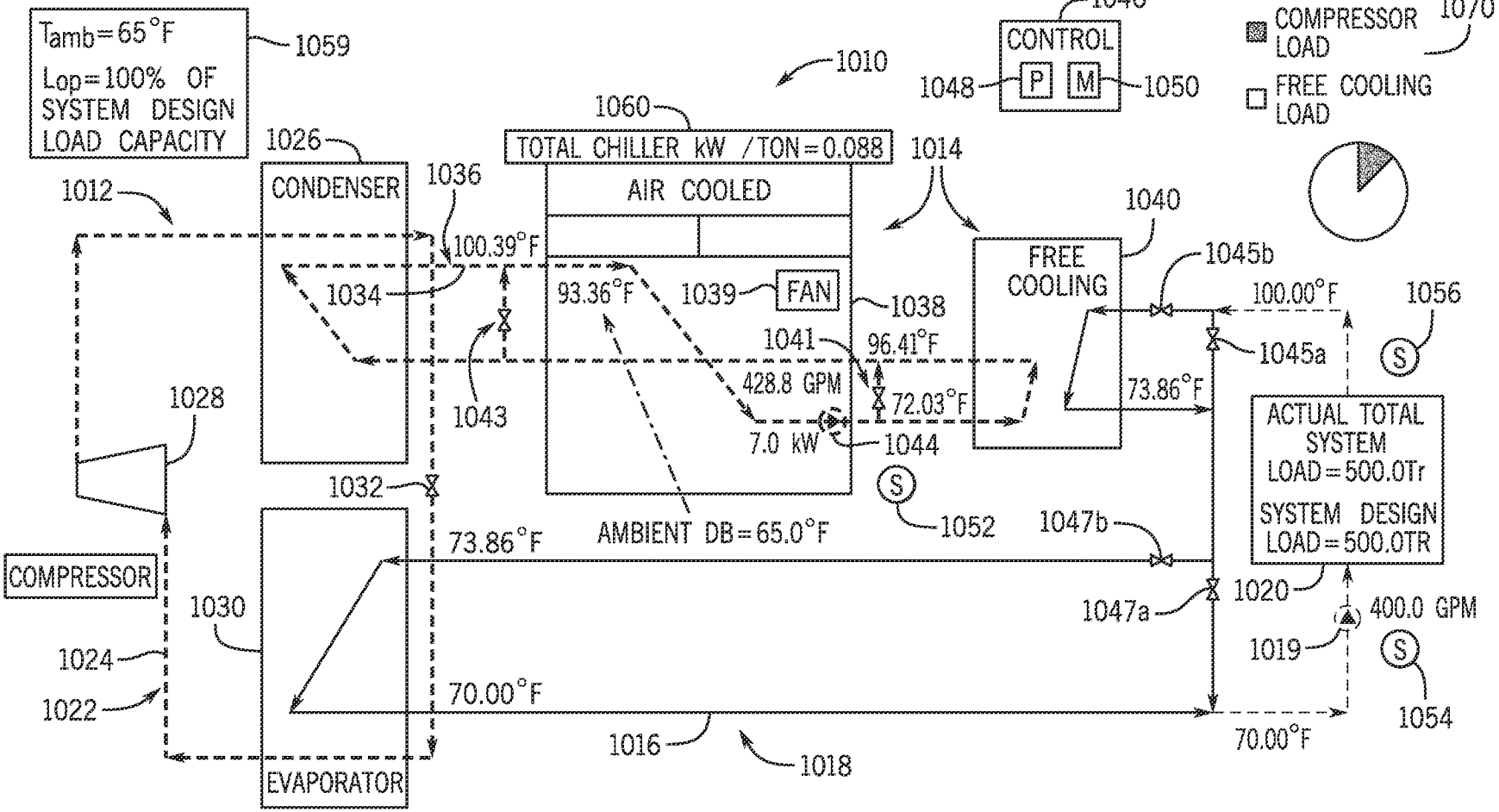
FIG. 3 is a schematic view of the HVAC&R system in FIG. 1 where ambient dry bulb temperature is 65 degrees Fahrenheit and an operating load is 100% of system design load capacity, in accordance with an aspect of the present disclosure.
Figure 4:
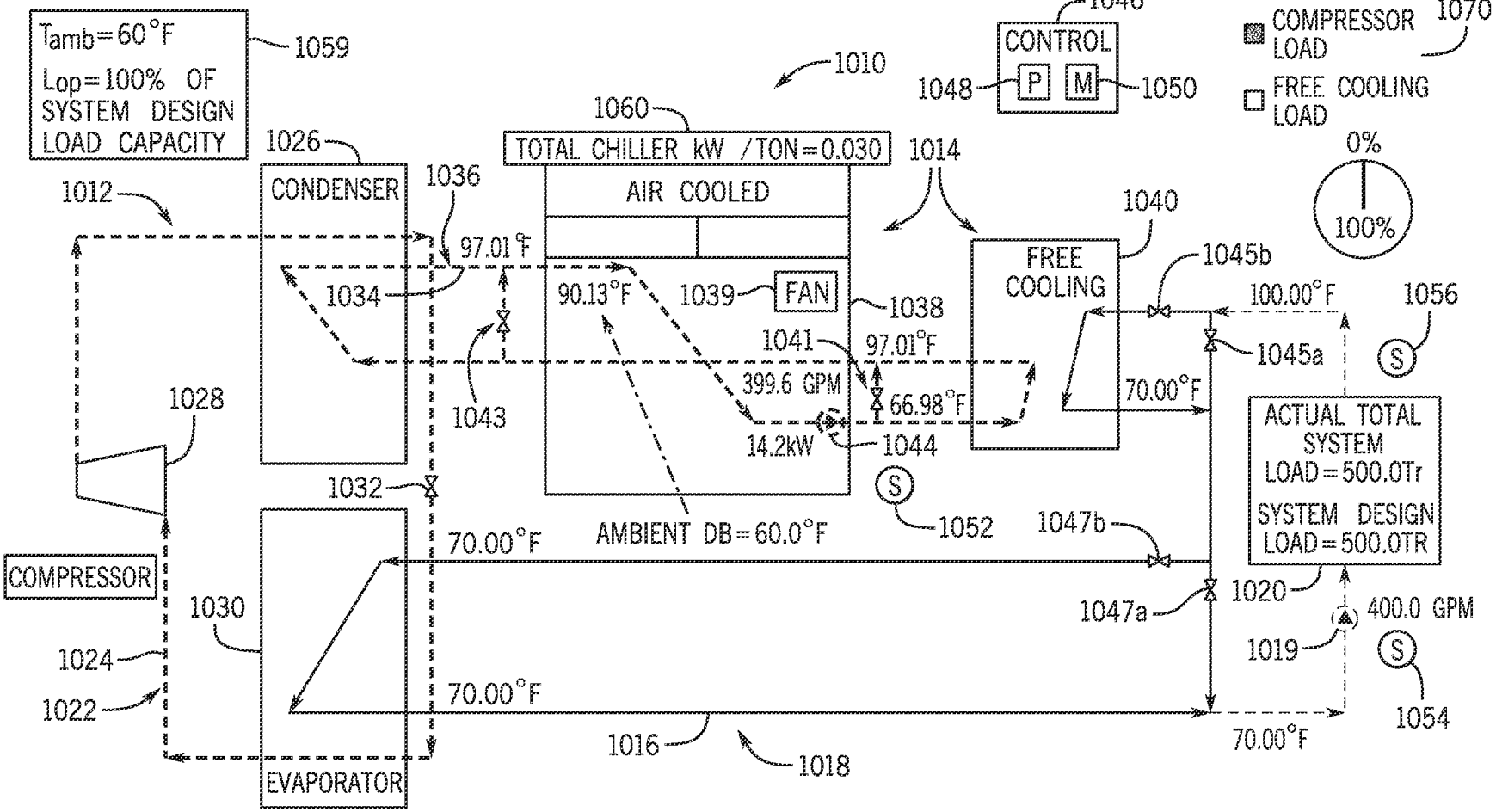
FIG. 4 is a schematic view of the HVAC&R system in FIG. 1 where ambient dry bulb temperature is 60 degrees Fahrenheit and an operating load is 100% of system design load capacity, in accordance with an aspect of the present disclosure.
Figure 5:
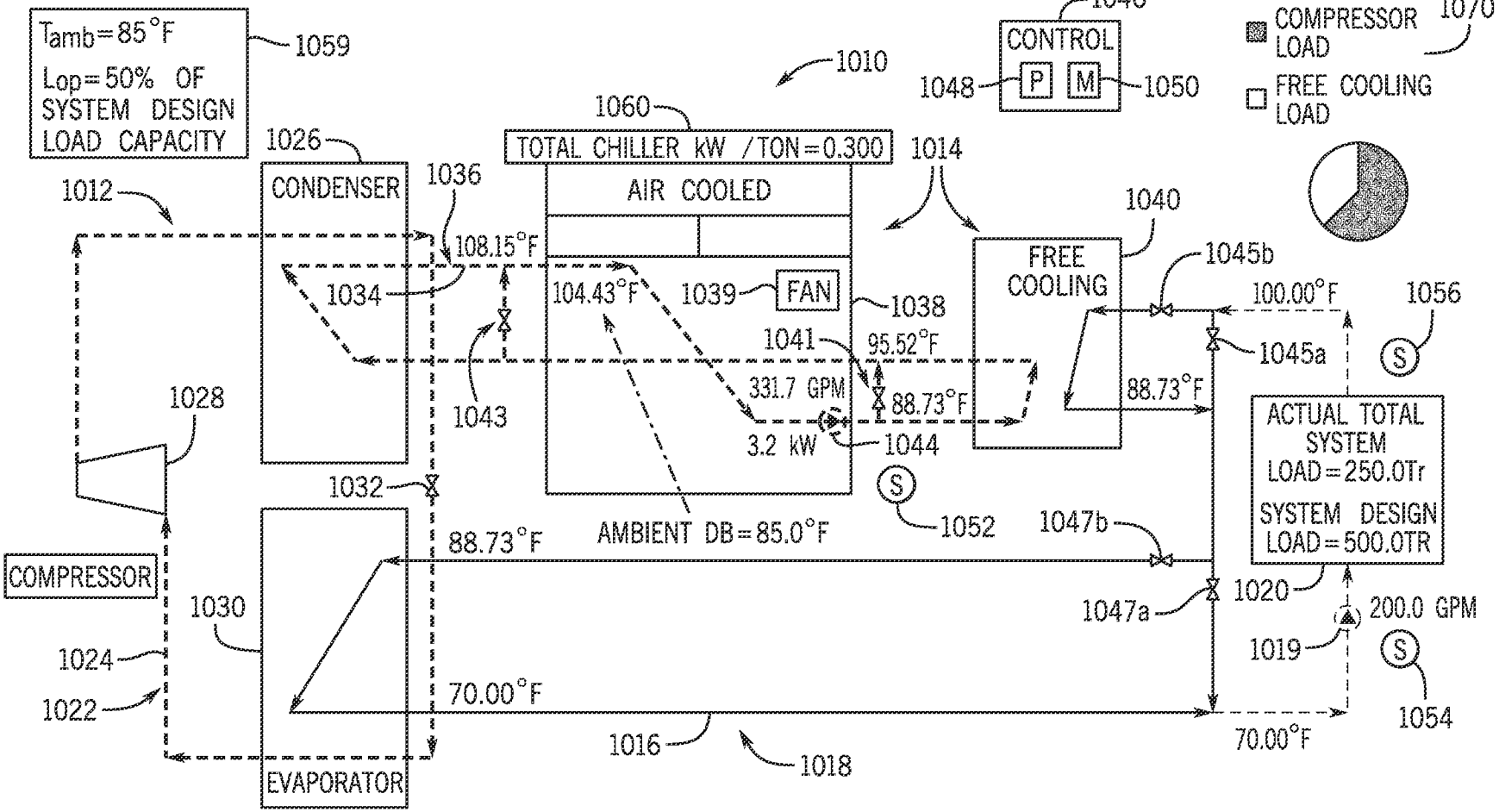
FIG. 5 is a schematic view of the HVAC&R system in FIG. 1 where ambient dry bulb temperature is 85 degrees Fahrenheit and an operating load is 50% of system design load capacity, in accordance with an aspect of the present disclosure.
Figure 6:
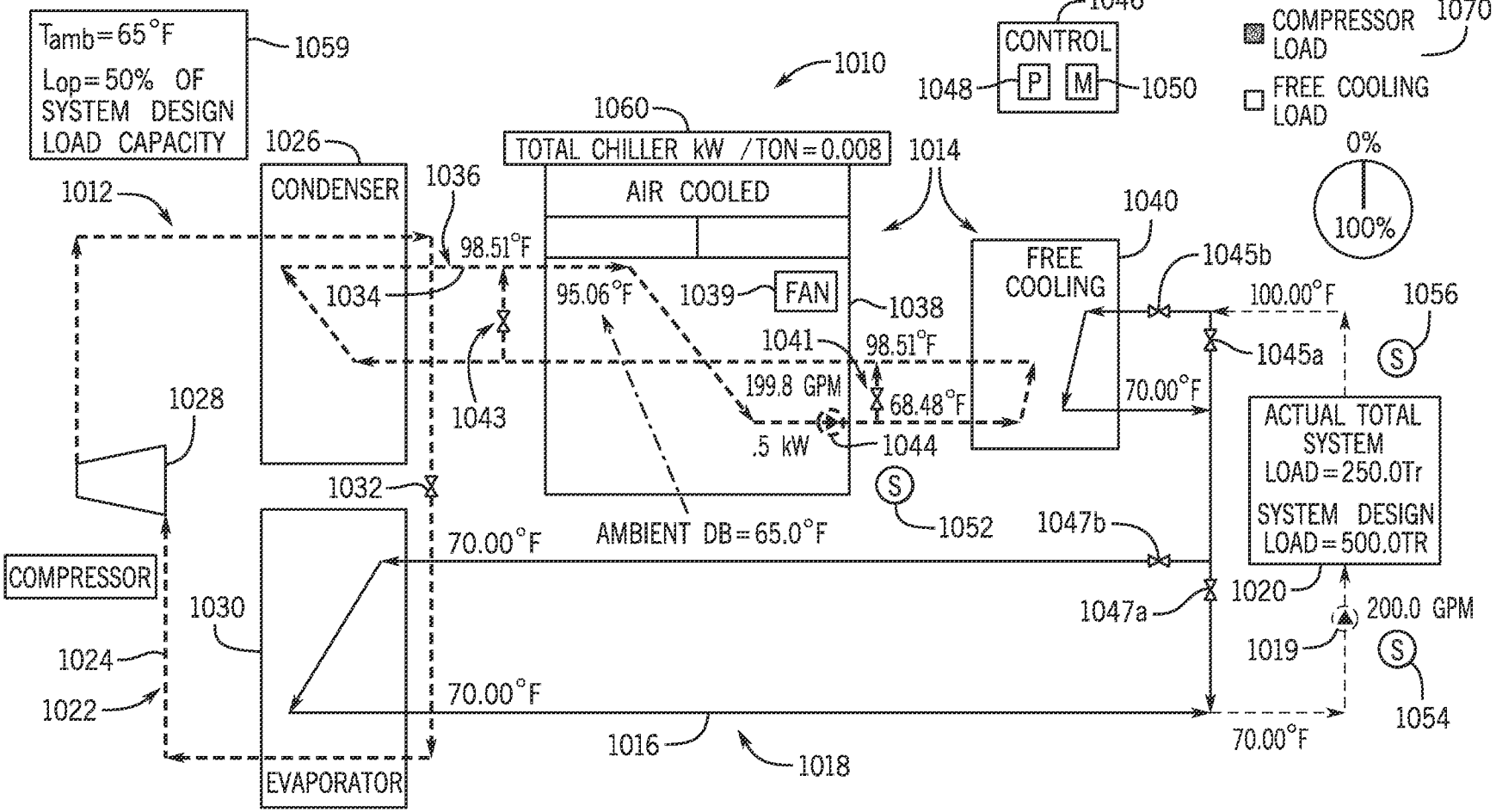
FIG. 6 is a schematic view of the HVAC&R system in FIG. 1 where ambient dry bulb temperature is 65 degrees Fahrenheit and an operating load is 50% of system design load capacity, in accordance with an aspect of the present disclosure.
Figure 7:
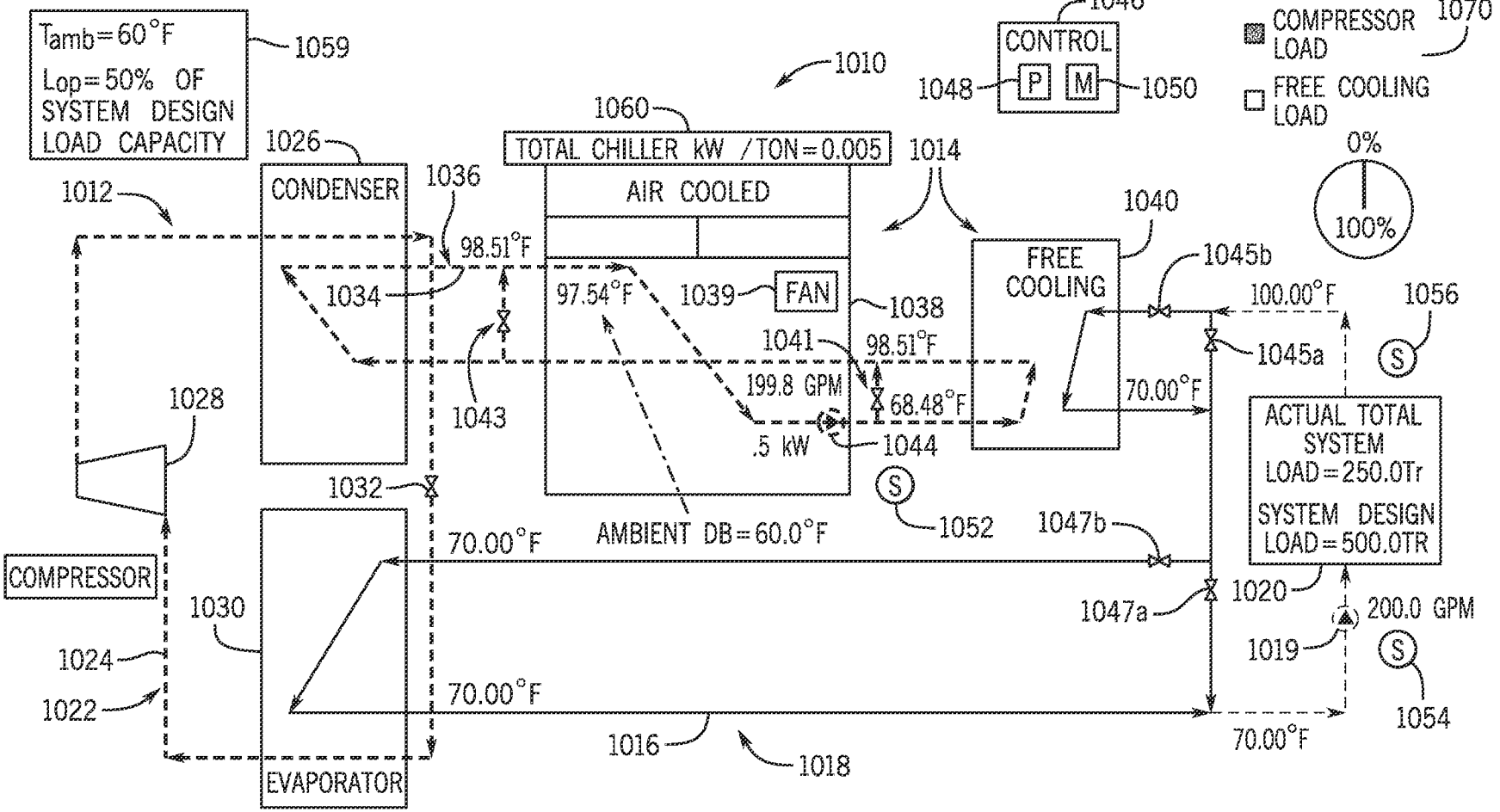
FIG. 7 is a schematic view of the HVAC&R system in FIG. 1 where ambient dry bulb temperature is 60 degrees Fahrenheit and an operating load is 50% of system design load capacity, in accordance with an aspect of the present disclosure.

FIGS. 2-7 illustrate various embodiments of the HVAC&R system 1010 in which ambient temperature (e.g., ambient dry bulb temperature) and operating load differs. As seen in FIGS. 2-7 and described in detail below, controls are modulated based at least in part on the ambient temperature and/or operating load. In FIGS. 2-4, operating load is 100% of system design load capacity (e.g., at ambient temperatures of 85 degrees Fahrenheit, 65 degrees Fahrenheit, and 60 degrees Fahrenheit, respectively). In FIGS. 5-7, operating load is 50% of system design load capacity (e.g., at ambient temperatures of 85 degrees Fahrenheit, 65 degrees Fahrenheit, and 60 degrees Fahrenheit, respectively). In general, the lower the ambient temperature and/or operating load, the more the HVAC&R system 1010 can rely on the free cooling assembly 1014 to meet cooling demands, thereby saving energy costs. Each of FIGS. 2-7 is described individually and in detail below.

FIG. 2 is a schematic view of an embodiment of the HVAC&R system 1010 in FIG. 1, where ambient temperature is 85 degrees Fahrenheit and an operating load is 100% of system design load capacity (e.g., as shown in legend 1059). Further, a supply temperature of the process fluid 1016 to the load 1020 is 70 degrees Fahrenheit, and a return temperature of the process fluid 1016 from the load 1020 is 100 degrees Fahrenheit. In the illustrated embodiment, the controller 1046 of the HVAC&R system 1010 controls one or more components of the HVAC&R system 1010 based, for example, on the ambient dry bulb temperature detected by the sensor 1052. The one or more components include, for example, the pumps 1019, 1044, the compressor 1028, the fan 1039 of the air cooled heat exchanger 1038, the first and second bypass valves 1041, 1043 associated with the internal fluid cooling loop 1036, and the various valves 1045*a*, 1045*b*, 1047*a*, 1047*b* associated with the process fluid loop 1018. A pump setting of the pump 1044, in particular, may be operated to control a flow of the cooling fluid 1034 in series through the plate frame heat exchanger 1040 and to the condenser 1026 based on the illustrated conditions described above.

Further, as shown, the first and second bypass valves 1041, 1043 are in a closed position such that the cooling fluid 1034 of the internal fluid cooling loop 1036 is routed to both the plate frame heat exchanger 1040 and the condenser 1026. Further, valve 1045*a* is closed and valve 1045*b* is open, and valve 1047*a* is closed and valve 1047*b* is open, thereby causing the process fluid 1016 of the process fluid loop 1018 to flow to both the plate frame heat exchanger 1040 and the evaporator 1030. In this way, the HVAC&R system 1010 relies on both mechanical cooling and free cooling to chill the process fluid 1016 in the illustrated conditions. Further, the compressor 1028 is operated based on the reliance in part on mechanical cooling. A pie chart 1070 illustrates a compressor load and free cooling load on the HVAC&R system 1010 in the illustrated conditions. As shown, in the illustrated conditions, the compressor load is 77% and the free cooling load is 23%. The illustrated controls rely on the vapor compression assembly 1012 as shown and described above due to the relatively high ambient temperature (e.g., 85 degrees Fahrenheit) and operating load (e.g., 100% of system design load capacity). However, in traditional configurations with the illustrated conditions (e.g., ambient conditions), reliance on the vapor compression assembly 1012 (e.g., a compressor load on the compressor 1028) may be substantially higher than the illustrated embodiment. Various performance and results data are illustrated in FIG. 2 and associated with the above-described conditions, including parameters associated with the compressor 1028, the condenser 1026, the evaporator 1030, the air cooled heat exchanger 1038 (or fan 1039 thereof), the plate frame heat exchanger 1040, the load 1020, the pumps 1019, 1044, temperatures of various fluids, flow rates of various fluids, power consumption of various componentry, etc. Further, as shown in block 1060, a total chiller kilowatts per refrigeration ton (kW/Ton) with the illustrated conditions and control features is 0.534.

FIG. 3 is a schematic view of an embodiment of the HVAC&R system 1010 in FIG. 1, where ambient temperature is 65 degrees Fahrenheit and an operating load is 100% of system design load capacity (e.g., as shown in legend 1059). Further, a supply temperature of the process fluid 1016 to the load 1020 is 70 degrees Fahrenheit, and a return temperature of the process fluid 1016 from the load 1020 is 100 degrees Fahrenheit. As shown in the pie chart 1070 illustrated in FIG. 3, reliance on the vapor compression assembly 1012 is less than in FIG. 2, based on the ambient dry bulb temperature being 65 degrees Fahrenheit instead of 85 degrees Fahrenheit. Indeed, in FIG. 3, the free cooling load is 87% and the compressor load is 13%. Various performance and results data are illustrated in FIG. 3 and associated with the above-described conditions, including parameters associated with the compressor 1028, the condenser 1026, the evaporator 1030, the air cooled heat exchanger 1038 (or fan 1039 thereof), the plate frame heat exchanger 1040, the load 1020, the pumps 1019, 1044, temperatures of various fluids, flow rates of various fluids, power consumption of various componentry, etc. Further, as shown in block 1060, a total chiller kilowatts per refrigeration ton (kW/Ton) with the illustrated conditions and control features is 0.088, significantly less than in FIG. 2. Like in FIG. 2, the HVAC&R system 1010 in FIG. 3 relies on both mechanical cooling and free cooling. Accordingly, the various valves 1041, 1043, 1045*a*, 1045*b*, 1047*a*, 1047*b* in FIG. 3 are in the same positions as shown in FIG. 2.

FIG. 4 is a schematic view of an embodiment of the HVAC&R system 1010 in FIG. 1, where ambient temperature is 60 degrees Fahrenheit and an operating load is 100% of system design load capacity (e.g., as shown in legend 1059). Further, a supply temperature of the process fluid 1016 to the load 1020 is 70 degrees Fahrenheit, and a return temperature of the process fluid 1016 from the load 1020 is 100 degrees Fahrenheit. Because of the relatively low ambient dry bulb temperature, the HVAC&R system 1010 is controlled to rely exclusively on free cooling. Accordingly, unlike FIGS. 2 and 3, the various valves of the HVAC&R system 1010 in FIG. 4 are controlled to divert or block the cooling fluid 1034 of the internal fluid cooling loop 1036 from the condenser 1026 and the process fluid 1016 of the process fluid loop 1018 from the evaporator 1030. Indeed, the second bypass valve 1043 of the internal fluid cooling loop 1036 is opened such that a portion of the cooling fluid 1034 bypasses the condenser 1026. Further, valve 1047*a* is opened and valve 1047*b* is closed such that the process fluid 1016 bypasses the evaporator 1030. As shown, the compressor 1028 is disconnected or otherwise shut off in response to the HVAC&R system 1010 relying exclusively on free cooling. Various performance and results data are illustrated in FIG. 3 and associated with the above-described conditions, including parameters associated with the compressor 1028, the condenser 1026, the evaporator 1030, the air cooled heat exchanger 1038 (or fan 1039 thereof), the plate frame heat exchanger 1040, the load 1020, the pumps 1019, 1044, temperatures of various fluids, flow rates of various fluids, power consumption of various componentry, etc. As shown in block 1060, a total chiller kilowatts per refrigeration ton (kW/Ton) with the illustrated conditions and control features is 0.030, significantly less than in FIGS. 2 and 3.

FIG. 5 is a schematic view of an embodiment of the HVAC&R system 1010 in FIG. 1, where ambient temperature is 85 degrees Fahrenheit and an operating load is 50% of system design load capacity (e.g., as shown in legend 1059). Further, a supply temperature of the process fluid 1016 to the load 1020 is 70 degrees Fahrenheit, and a return temperature of the process fluid 1016 from the load 1020 is 100 degrees Fahrenheit. In the illustrated embodiment, the HVAC&R system 1010 relies on both free cooling and mechanical cooling, as indicated in the pie chart 1070. FIG. 5 is similar to FIG. 2 in that, in both embodiments, the ambient dry bulb temperature is 85 degrees Fahrenheit. However, because the operating load in FIG. 5 is less than (e.g., half of) the operating load in FIG. 2, the HVAC&R system 1010 illustrated in FIG. 5 relies on mechanical cooling less than the HVAC&R system 1010 illustrated in FIG. 2. In other words, the compressor load in FIG. 5 is less than the compressor load in FIG. 2, and the percentage free cooling load in FIG. 5 is greater than the percentage free cooling load in FIG. 2. Because of the increased reliance on free cooling in FIG. 5, the total chiller kilowatts per refrigeration ton (kW/Ton) in FIG. 5 (e.g., 0.300) is less than the total chiller kilowatts per refrigeration ton (kW/Ton) in FIG. 2 (e.g., 0.534). In general, the various valves 1041, 1043, 1045*a*, 1045*b*, 1047*a*, 1047*b* are controlled to the same positions in FIG. 5 as they are in FIG. 2. However, control of other features may differ, such as control of a pump setting of the pumps 1019 and 1044, a fan setting of the fan 1039, a compressor setting of the compressor 1028.

FIG. 6 is a schematic view of an embodiment of the HVAC&R system 1010 in FIG. 1, where ambient temperature is 65 degrees Fahrenheit and an operating load is 50% of system design load capacity (e.g., as shown in legend 1059). Further, a supply temperature of the process fluid 1016 to the load 1020 is 70 degrees Fahrenheit, and a return temperature of the process fluid 1016 from the load 1020 is 100 degrees Fahrenheit. In the illustrated embodiment, the HVAC&R system 1010 relies exclusively on free cooling. Indeed, the compressor 1028 is shut off or otherwise disconnected, the second bypass valve 1043 of the internal fluid cooling loop 1036 is open to bypass a portion of the cooling fluid 1034 from the condenser 1026, and the valves 1047*a*, 1047*b* are actuated to divert or block the process fluid 1016 from the evaporator 1030 (e.g., valve 1047*a* is open and valve 1047*b* is closed). The first bypass valve 1041 is closed such that the cooling fluid 1034 is flowed, via the internal fluid cooling loop 1036, to the plate frame heat exchanger 1040. FIG. 6 can be contrasted with FIG. 3 in that, despite the fact that the ambient dry bulb temperature (e.g., 65 degrees Fahrenheit) is the same in both, the HVAC&R system 1010 in FIG. 6 relies exclusively on free cooling, while he HVAC&R system 1010 in FIG. 3 relies on both free cooling and mechanical cooling. This distinction may occur because the operating load in FIG. 6 is substantially less than (e.g., half of) the operating load in FIG. 3. Further, as illustrated in block 1060 of FIG. 6, a total chiller kilowatts per refrigeration ton (kW/Ton) with the illustrated conditions and control features is 0.008, significantly less than in FIGS. 2-5.

FIG. 7 is a schematic view of an embodiment of the HVAC&R system 1010 in FIG. 1, where ambient temperature is 60 degrees Fahrenheit and an operating load is 50% of system design load capacity (e.g., as shown in legend 1059). Further, a supply temperature of the process fluid 1016 to the load 1020 is 70 degrees Fahrenheit, and a return temperature of the process fluid 1016 from the load 1020 is 100 degrees Fahrenheit. Like FIG. 6, FIG. 7 includes exclusive or complete reliance on free cooling. However, due to the lower ambient dry bulb temperature in FIG. 7 being lower than in FIG. 6, the HVAC&R system 1010 operates with less energy consumption in FIG. 7 than FIG. 6. Indeed, as shown in block 1060 in FIG. 7, a total chiller kilowatts per refrigeration ton (kW/Ton) with the illustrated conditions and control features is 0.005, which is lower than the total chiller kilowatts per refrigeration ton (kW/Ton) of 0.008 in FIG. 6.

In general, the HVAC&R system 1010 in accordance with the present disclosure is configured to rely more heavily on the free cooling assembly 1014 than the vapor compression assembly 1012 relative to traditional embodiments, whether the HVAC&R system 1010 is operated to rely on only the vapor compression assembly 1012 for cooling the process fluid 1016, only the free cooling assembly 1014 for cooling the process fluid 1016, or on both the vapor compression assembly 1012 and the free cooling assembly 1014 for cooling the process fluid 1016.

Figure 8:
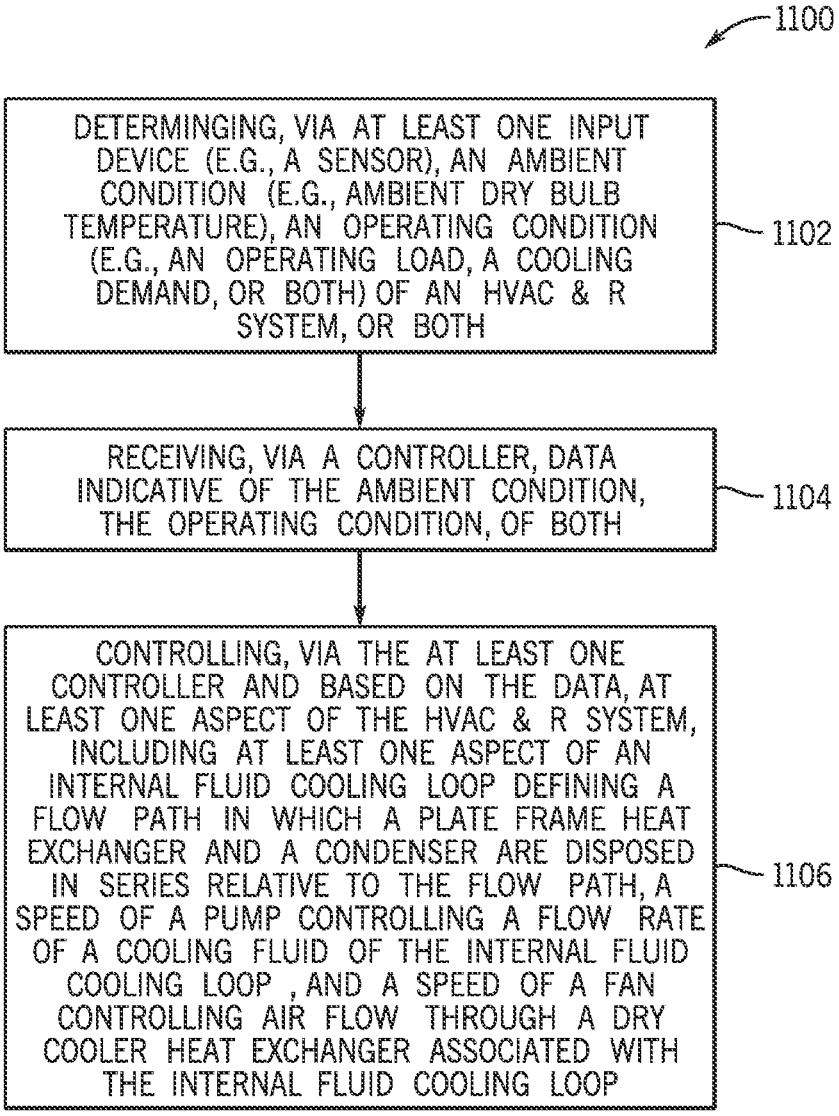
FIG. 8 is a process flow diagram illustrating a method of operating the HVAC&R system of FIG. 1, in accordance with an aspect of the present disclosure.

FIG. 8 is a process flow diagram illustrating an embodiment of a method 1100 of operating the HVAC&R system of FIG. 1. In the illustrated embodiment, the method 1100 includes determining (block 1102), via at least one input device (e.g., a sensor), an ambient condition (e.g., ambient dry bulb temperature), an operating condition (e.g., an operating load, a cooling demand, or both) of the HVAC&R system, or both.

The method 1100 also includes, receiving (block 1104), via at least one controller, data indicative of the ambient condition, the operating condition, or both. The method 1100 also includes controlling (block 1106), via the at least one controller and based on the data, at least one aspect of the HVAC&R system, including at least one aspect of an internal fluid cooling loop defining a flow path in which a plate frame heat exchanger and a condenser are disposed in series relative to the flow path. For example, as previously described, a pump setting of a pump configured to bias the cooling fluid through the internal fluid cooling loop, a bypass valve disposed on the internal fluid cooling loop adjacent the plate frame heat exchanger, a bypass valve disposed on the internal fluid cooling loop adjacent the condenser, a pump setting of a pump configured to bias the process fluid through the process fluid loop, and/or a fan setting of a fan of an air cooled heat exchanger associated with the internal fluid cooling loop may be controlled, via the controller, based on the data indicative of the ambient condition, the operating condition of the HVAC&R system, or both. In this way, the flow rate of the cooling fluid biased through the internal fluid cooling loop may be controlled, which may dictate a speed at which the cooling fluid travels through the plate frame heat exchanger prior to being delivered to the condenser. In this way, relative amounts of heat exchange at the plate frame heat exchanger and the condenser may be controlled such that relative amounts of reliance on the free cooling assembly and/or the vapor compression assembly may be controlled.

Other aspects of the HVAC&R system may also be controlled based on the ambient condition and/or the operating condition, and/or based on controls of the above-described features of the internal fluid cooling loop. For example, the controller may control a setting of a process fluid pump of a process fluid loop, one or more valve(s) on the process fluid loop, and/or a setting of a compressor.

The features illustrated in, and described above with respect to, FIGS. 1-7 are examples of HVAC&R systems employing a vapor compression assembly and a free cooling assembly, in which the free cooling assembly is prioritized for energy savings and reduced refrigerant charge in the vapor compression assembly. The componentry illustrated in FIGS. 1-7 and described in detail above may enable the energy savings and the reduced refrigerant charge relative to traditional embodiments. Of course, FIG. 8 represents a process of controlling the system(s) illustrated in FIGS. 1-7. However, FIGS. 1-8 and corresponding description are merely exemplary, and other componentry or process steps intended to enable the above-described technical effects and/or further improve energy savings and reduce refrigerant charge are also possible.

Figure 9:
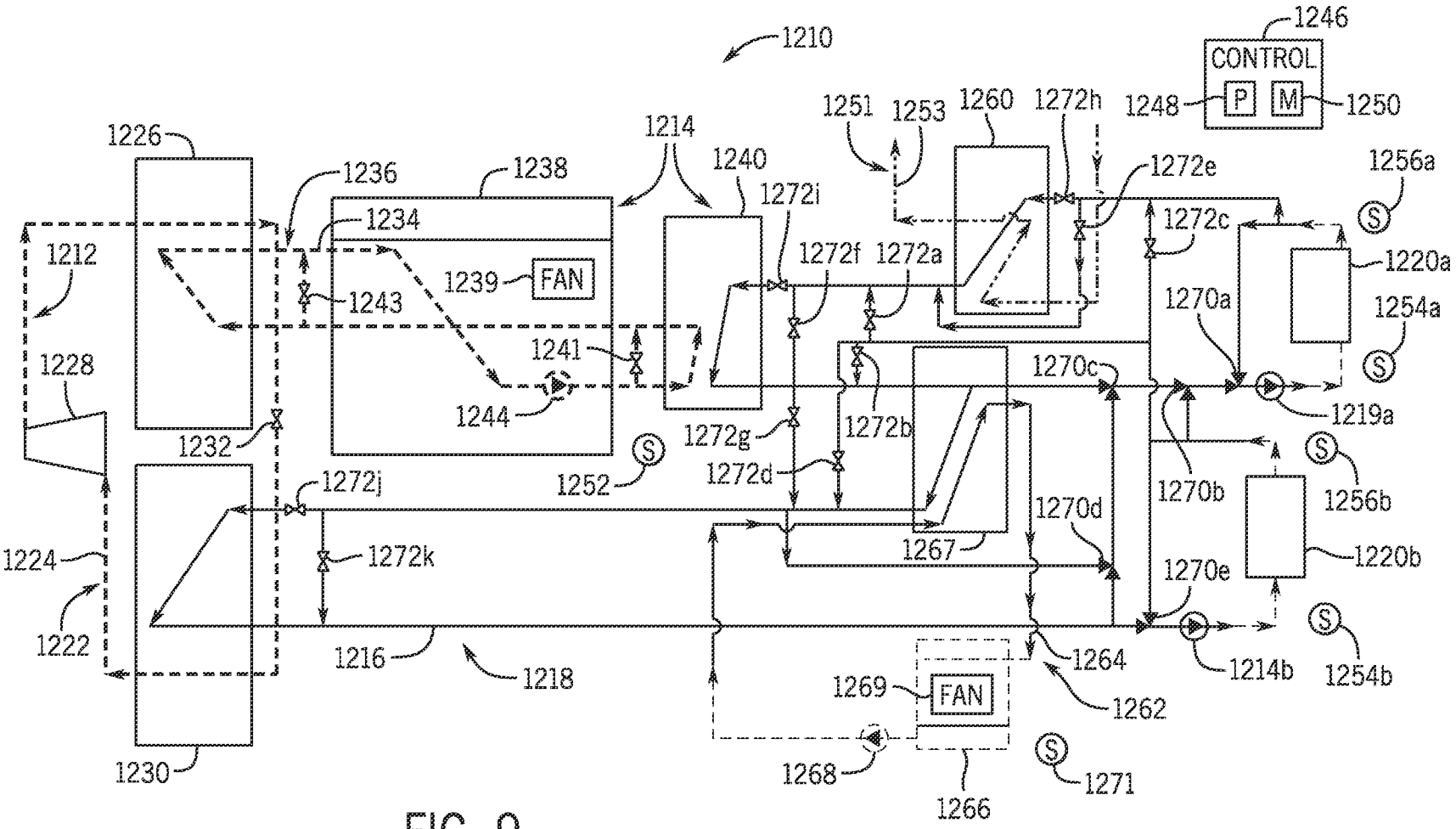
FIG. 9 is a schematic view of a multi-temperature hydronic system employing a vapor compression assembly (or chiller assembly), a free cooling assembly, and control features configured to direct a cooling fluid in series through a heat exchanger (e.g., plate frame heat exchanger) of the free cooling assembly and a condenser of the vapor compression assembly, in accordance with an aspect of the present disclosure.

For example, FIG. 9 is a schematic view of an embodiment of a multi-temperature hydronic system 1210 employing a vapor compression assembly 1212 (or chiller assembly), a free cooling assembly 1214, and control features configured to modulate a reliance on the vapor compression assembly 1212 and the free cooling assembly 1214.

In general, the vapor compression assembly 1212 and the free cooling assembly 1214 are configured to cool a process fluid 1216 (e.g., water, glycol, a water-glycol mixture, a dielectric fluid in liquid immersion applications, etc.) corresponding to a process fluid loop 1218, where the process fluid 1216 is biased through the process fluid loop 1218 via one or more pumps 1219*a*, 1219*b*. As shown, the process fluid loop 1218 may guide the process fluid 1216 to one or more loads 1220*a*, 1220*b*. In the illustrated embodiment, the load 1220*a* is a medium or high temperature load and the load 1220*b* is a low temperature load. Depending on ambient conditions and/or operating conditions of the HVAC&R system 1210, a reliance on the vapor compression assembly 1212 and/or a reliance on the free cooling assembly 1214 for cooling the process fluid 1216 may be modulated to ensure adequate cooling and reduce energy consumption of the HVAC&R system 1210 (e.g., relative to traditional embodiments).

The vapor compression assembly 1212 may include a vapor compression loop 1222 (referred to in certain instances of the present disclosure as a working fluid loop) that routes a working fluid 1224 (e.g., a refrigerant, such as R-123, R-514A, R-1224yd, R-1233zd, R-134a, R-1234ze, R-1234yf, R-1311, R-32, R-410A, or others) through various components of the vapor compression assembly 1212. For example, the vapor compression loop 1222 may route the working fluid 1224 through a compressor 1228, a condenser 1226, an expansion valve 1232, and an evaporator 1230 of the vapor compression assembly 1212. The compressor 1228 may operate to bias the working fluid 1224 through the vapor compression loop 1222 (e.g., by increasing a pressure of the working fluid 1224) in certain conditions. The evaporator 1230 may operate to cool the process fluid 1216 of the process fluid loop 1218 in certain conditions. The expansion valve 1232 may operate to reduce a pressure of the working fluid 1224 between the condenser 1226 and the evaporator 1230. The condenser 1226 may operate to remove heat from the working fluid 1224 in certain conditions via fluid-to-liquid cooling in which heat is transferred from the working fluid 1224 to a cooling fluid 1234 (e.g., water, glycol, a water-glycol mixture, etc.) corresponding to an internal fluid cooling loop 1236 of the free cooling assembly 1214. In this way, the condenser 1226 may be considered a part of the internal fluid cooling loop 1236 while the cooling fluid 1234 of the internal fluid cooling loop 1236 is circulating through the condenser 1226.

As previously described, in certain ambient conditions and/or operating conditions of the HVAC&R system 1210, the free cooling assembly 1214 may be employed to reduce a reliance on the vapor compression assembly 1212 for cooling the process fluid 1216 of the process fluid loop 1218. For example, as a reliance on the free cooling assembly 1214 is increased in response to certain conditions, a reliance on the compressor 1228 of the vapor compression assembly 1212 may be reduced. In certain conditions, the compressor 1228 may be entirely disconnected or otherwise turned off while the HVAC&R system 1210 relies only on the free cooling assembly 1214 to provide cooling to the process fluid 1216. Additionally or alternatively, the HVAC&R system 1210 may rely on both the free cooling assembly 1214 and the vapor compression assembly 1212 in certain conditions with the compressor 1228 controlled to a relatively low setting, thereby improving energy efficiency while ensuring adequate cooling of the process fluid 1216. It should be noted that the internal fluid cooling loop 1236 in FIG. 9 may be structurally the same as, or structurally similar to, the internal fluid cooling loop 1036 illustrated in FIGS. 2-7 and described in detail above, although controls of the pump 1244 and/or the fan 1239 may differ. For example, the internal fluid cooling loop 1236 in FIG. 9 includes a first bypass valve 1241, a second bypass valve 1243, and a pump 1244. Likewise, the vapor compression assembly 1212 of FIG. 9 may be structurally the same as, or structurally similar to, the vapor compression assembly 1012 illustrated in FIGS. 2-7 and described in detail above, although controls of the compressor 1228 may differ.

When the cooling fluid 1234 is present at the condenser 1226, the cooling fluid 1234 absorbs heat from the working fluid 1224 corresponding to the vapor compression assembly 1212, causing the working fluid 1224 to condenser prior to delivery of the working fluid 1224 to the expansion valve 1232. When the cooling fluid 1234 is present at the plate frame heat exchanger 1240, the cooling fluid 1234 absorbs heat from the process fluid 1216 corresponding to the process fluid loop 1218. Aspects of the free cooling assembly 1214 may be controlled to allocate some, none, or all of the cooling fluid 1234 to the condenser 1226 and some, none, or all of the cooling fluid 1234 to the plate frame heat exchanger 1240, as described in detail below.

The controller 1246 of the HVAC&R system 1210, which includes processing circuitry 1248 and memory circuitry 1250, may be employed to control various of the above-described components. For example, the controller 1246 may receive one or more inputs indicative of various ambient conditions (e.g., ambient dry bulb temperature) and/or operating conditions of the HVAC&R system 1210. Indeed, the controller 1246 may receive, from a first sensor 1252, a first input indicative of an ambient temperature (e.g., proximate the air cooled heat exchanger 1238). Additionally or alternatively, the controller 1246 may receive, from second sensors 1254*a*, 1254*b*, second inputs indicative of a supply temperature of the process fluid 1216 directed to the loads 1220*a*, 1220*b*. Additionally or alternatively, the controller 1246 may receive, from third sensors 1256*a*, 1256*b*, third inputs indicative of a return temperature of the process fluid 1216 returned from the loads 1220*a*, 1220*b*. In some embodiments, the controller 1246 may employ target supply temperatures of the process fluid 1216 directed to the loads 1220*a*, 1220*b* and/or target return temperatures of the process fluid 1216 returned from the loads 1220*a*, 1220*b* (e.g., in addition to, or in the alternate of, the detected temperatures). Additionally or alternatively, the controller 1246 may receive (or otherwise determine) fourth inputs indicative of operating loads corresponding to the HVAC&R system 1210 and/or the loads 1220*a*, 1220*b*. Other inputs, such as ambient wet bulb temperature, may also be employed for controls of other features in the illustrated HVAC&R system 1210, as described in detail below.

In the illustrated embodiment, the HVAC&R system 1210 includes a heat recapture path 1251 configured to flow a heat recapture fluid 1253 to a heat exchanger 1260. The heat exchanger 1260 may be employed to receive a portion of the process fluid 1216, such that the heat recapture fluid 1253 and the process fluid 1216 are placed in a heat exchange relationship at the heat exchanger 1260 of the heat recapture path 1251.

As noted above, the HVAC&R system 1210 employs the working fluid 1224, the cooling fluid 1234, the process fluid 1216, and the heat recapture fluid 1253. In the illustrated embodiment, the HVAC&R system may employ a fifth fluid loop 1262 that flows a fifth fluid 1264 (e.g., water, glycol, water-glycol mixture) for additional cooling purposes. The fifth fluid loop 1262 may flow the fifth fluid 1264 through a cooling tower 1266 and a wet economizer heat exchanger 1267. A pump 1268 may be employed to bias the fifth fluid 1264 through the fifth fluid loop 1262. At the wet economizer heat exchanger 1267, the fifth fluid 1264 may extract heat from the process fluid 1216. Further, the cooling tower 1266 may include a fan 1269 controlled (e.g., by the controller 1246) to various fan settings based at least in part on a wet bulb temperature detected by a sensor 1271, such that the cooling tower 1266 (e.g., the fan 1269 of the cooling tower 1266) provides sufficient cooling to the fifth fluid 1264. In some embodiments, a pump setting of the pump 1268 may also be controlled based on the ambient wet bulb temperature detected by the sensor 1271 and/or other ambient conditions or operating conditions of the HVAC&R system 1210.

The process fluid loop 1218 in FIG. 9 also includes a series of flow-diverting valves 1270*a*, 1270*b*, 1270*c*, 1270*d*, 1270*e* controlled to various settings to cause various flows of the process fluid 1216 through various pathways of the process fluid loop 1218. Further, the process fluid loop 1218 includes a series of bypass valves 1272*a*, 1272*b*, 1272*c*, 1272*d*, 1272*e*, 1272*f*, 1272*g*, 1272*h*, 1272*i*, 1272*j*, 1272*k* employed to open and close various paths in the process fluid loop 1218. The controller 1246 may control the flow-diverting valves 1270*a*, 1270*b*, 1270*c*, 1270*d*, 1270*e* and the bypass valves 1272*a*, 1272*b*, 1272*c*, 1272*d*, 1272*e*, 1272*f*, 1272*g*, 1272*h*, 1272*i*, 1272*j*, 1272*k* (e.g., based on ambient conditions, operating conditions of the HVAC&R system 1210, etc.) to control the flow of the process fluid 1216 through various componentry of the HVAC&R system 1210 described in detail above. An example of a multi-temperature hydronic system with flow control features can be found in PCT/US22/19819, entitled "MULTI-STAGE THERMAL MANAGEMENT SYSTEMS AND METHODS," filed Mar. 10, 2022, which is hereby incorporated by reference in its entirety.

Figure 10:
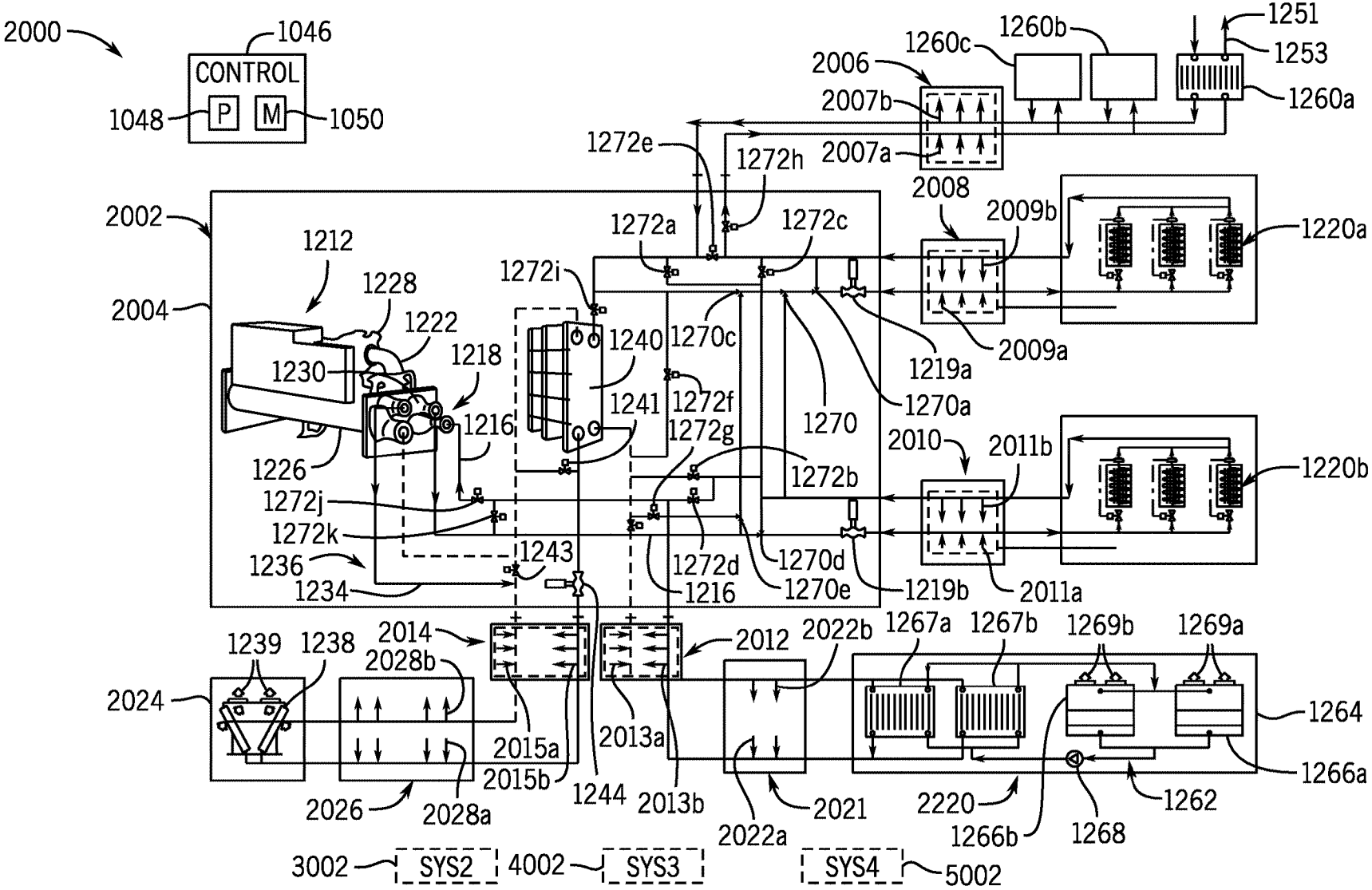
FIG. 10 is a schematic view of a multi-temperature hydronic system with central system connections between various modular central utility plants ("mCUPs") to provide enhanced capacity, resiliency, and/or redundancy for cooling one or more loads, in accordance with an aspect of the present disclosure.

FIG. 10 is a schematic view of an embodiment of a multi-temperature hydronic system 2000 employing central system connections between various modular central utility plants ("mCUPs") to provide enhanced capacity, resiliency, and/or redundancy for cooling one or more loads. In the illustrated embodiment, for example, the system 2000 includes a modular central utility plant 2002 (e.g., "mCUP") having the vapor compression assembly 1212 (or chiller assembly) illustrated in FIG. 9, among other features. The vapor compression assembly 1212 is configured to receive the cooling fluid 1234 of the internal fluid cooling loop 1236 and the process fluid 1216 of the process fluid loop 1218, as previously described. Further, the vapor compression assembly 1212 includes the vapor compression loop 1222, the compressor 1228, the condenser 1226, the evaporator 1230, and the expansion valve 1232 (not shown in FIG. 10, but illustrated in FIG. 9). The mCUP 2002 also includes the plate frame heat exchanger 1240, the flow-diverting valves 1270*a*, 1270*b*, 1270*c*, 1270*d*, 1270*e*, the bypass valves 1272*a*, 1272*b*, 1272*c*, 1272*d*, 1272*e*, 1272*f*, 1272*g*, 1272*h*, 1272*i*, 1272*j*, 1272*k*, the pumps 1219*a*, 1219*b*, 1244, and the first and second bypass valves 1241, 1243 of the internal fluid cooling loop 1236, all of which are also illustrated in FIG. 9.

In some embodiments, the mCUP 2002 is a modularized or containerized unit (e.g., where the above-described componentry is disposed in a housing 2004 of the mCUP 2002). The controller 1246 (e.g., including the processing circuitry 1248 and the memory circuitry 1250) may be employed to control some or all of the above-described componentry, in addition to any of the componentry of the system 2000 described below. In some embodiments, multiple instances of the controller 1246 are employed, where such multiple instances of the controller 1246 are configured to communicate with each other for control of various aspects of the system 2000. Further, while the sensors illustrated in FIG. 9 are not illustrated in FIG. 10, it should be noted that the same or similar sensors in FIG. 9 may be employed in FIG. 10.

Various connection interfaces may be employed to couple the mCUP 2002 of the system 2000 with other mCUPs that are the same as, or similar to, the mCUP 2002. For example, a first connection interface 2006, a second connection interface 2008, a third connection interface 2010, a fourth connection interface 2012, and a fifth connection interface 2014 may be employed in the system 2000. These connection interfaces 2006, 2008, 2010, 2012, 2014 each include three inlets and three outlets. For example, the first connection interface 2006 includes three inlets 2007*a* and three outlets 2007*b* as shown, the second connection interface 2008 includes three inlets 2009*a* and three outlets 2009*b* as shown, the third connection interface 2010 includes three inlets 2011*a* and three outlets 2011*b* as shown, the fourth connection interface 2012 includes three inlets 2013*a* and three outlets 2013*b* as shown, and the fifth connection interface 2014 includes three inlets 2015*a* and three outlets 2015*b* as shown. The inlets and outlets described above may be configured to be coupled to like locations corresponding to additional mCUPs, such as second, third, and fourth mCUPs 3002, 4002, 5002, similar to the mCUP 2002 illustrated in FIG. 10. In this way, the mCUPs 2002, 3002, 4002, 5002 may form a plant system that can share fluids and/or heat rejection devices for purposes of improving capacity, resiliency, and/or redundancy across the mCUPs 3002, 4002, 5002 of the system 2000.

The first connection interface 2006 is disposed on the process fluid loop 1218 between the mCUP 2002 and one or more heat exchangers 1260*a*, 1260*b*, 1260*c* corresponding to the heat recapture path 1251 of the heat recapture fluid 1253. The second connection interface 2008 is disposed on the process fluid loop 1218 between the mCUP 2002 and one or more instances of the load 1220*a* (e.g., medium or high temperature load[s]). The third connection interface 2010 is disposed on the process fluid loop 1218 between the mCUP 2002 and one or more instances of the load 1220*b* (e.g., low temperature load[s]). The fourth connection interface 2012 is disposed on the process fluid loop 1218 between the mCUP 2002 and a wet free cooling heat exchanger and cooling tower assembly 2020, described in greater detail below. The fifth connection interface 2014 is disposed on the internal fluid cooling loop 1236 between the mCUP 2002 and one or more dry cooler assemblies 2022, described in greater detail below.

The wet free cooling heat exchanger and cooling tower assembly 2020 in FIG. 10 includes certain of the same or similar componentry described with respect to FIG. 9. For example, the assembly 2020 includes wet economizer heat exchangers 1267*a*, 1267*b* configured to reject heat in the process fluid 1216 to the fifth fluid 1264 of the fifth fluid loop 1262. Further, the assembly 2020 includes cooling towers 1266*a*, 1266*b* configured to cool the fifth fluid 1264 via corresponding fans 1269*a*, 1269*b*, and the pump 1268 configured to bias the fifth fluid 1264 through the fifth fluid loop 1262. As shown, a connection interface 2021 may be employed to couple to additional instances of the assembly 2020. In the illustrated embodiment, the connection interface 2021 includes two inlets 2022*a* and two outlets 2022*b* for coupling to two additional instances of the assembly 2020, although fewer or greater such inlets and outlets (and corresponding instances of the assembly 2020) may be employed in other embodiments.

Similar to the embodiment illustrated in FIG. 9, the system 2000 in FIG. 10 employs the air cooled heat exchanger 1238 with one or more corresponding fans 1239 (e.g., in a dry cooler assembly 2024). In this way, the dry cooler assembly 2024 may cool the cooling fluid 1234 of the internal fluid cooling loop 1236 as similarly described with respect to FIG. 9. Further, a connection interface 2026 may be positioned on the internal fluid cooling loop 1236 between the mCUP 2002 and the dry cooler assembly 2024. The connection interface 2026 includes various inlets 2028*a* (e.g., four inlets) and various outlets 2028*b* (e.g., four outlets) for coupling to additional instances of the dry cooler assembly 2024. It should be noted that a larger or smaller number of such inlets and outlets (and corresponding instances of the dry cooler assembly 2024) may be employed in other embodiments.

The controller(s) 1246 of the system 2000 may control a flow of the process fluid 1216 to and through the various mCUPs 2002, 3002, 4002, 5002 by controlling operation of pumps corresponding to the process fluid loop(s) of the mCUPs 2002, 3002, 4002, 5002. For example, pump settings of the pumps 1219*a*, 1219*b* of the mCUP 2002, and pump settings of like pumps corresponding to the additional mCUPs 3002, 4002, 5002, may be controlled to bias the process fluid 1216 through various portions of the system 2000. Additionally or alternatively, the controller(s) 1246 of the system 2000 may control a flow of the cooling fluid 1234 to and through the various mCUPs 2002, 3002, 4002, 5002 by controlling operation of pumps corresponding to the internal fluid cooling loop(s) of the mCUPs 2002, 3002, 4002, 5002. For example, a pump setting of the pump 1244 of the mCUP 2002, and pump settings of like pumps corresponding to the additional mCUPs 3002, 4002, 5002, may be controlled to bias the cooling fluid 1234 through various portions of the system 2000.

The above-described componentry may enable improved capacity, redundancy, and/or resiliency of the system 2000 in servicing the loads 1220*a*, 1220*b*. In certain embodiments, the system 2000 includes the illustrated loads 1220*a*, 1220*b* shared between the mCUPs 2002, 3002, 4002, 5002, while in other embodiments, the mCUP 2002, 3002, 4002, 5002 may correspond to multiple instances of each of the loads 1220*a*, 1220*b* and/or other loads in accordance with the present disclosure. In general, the various heat rejection devices (e.g., the heat exchanger(s) 1260, the wet free cooling heat exchanger and cooling tower assembly or assemblies 2020, and the dry cooler assembly or assemblies 2024) may be shared between the mCUPs 2002, 3002, 4002, 5002 of the system 2000 as previously described.

Figure 11:
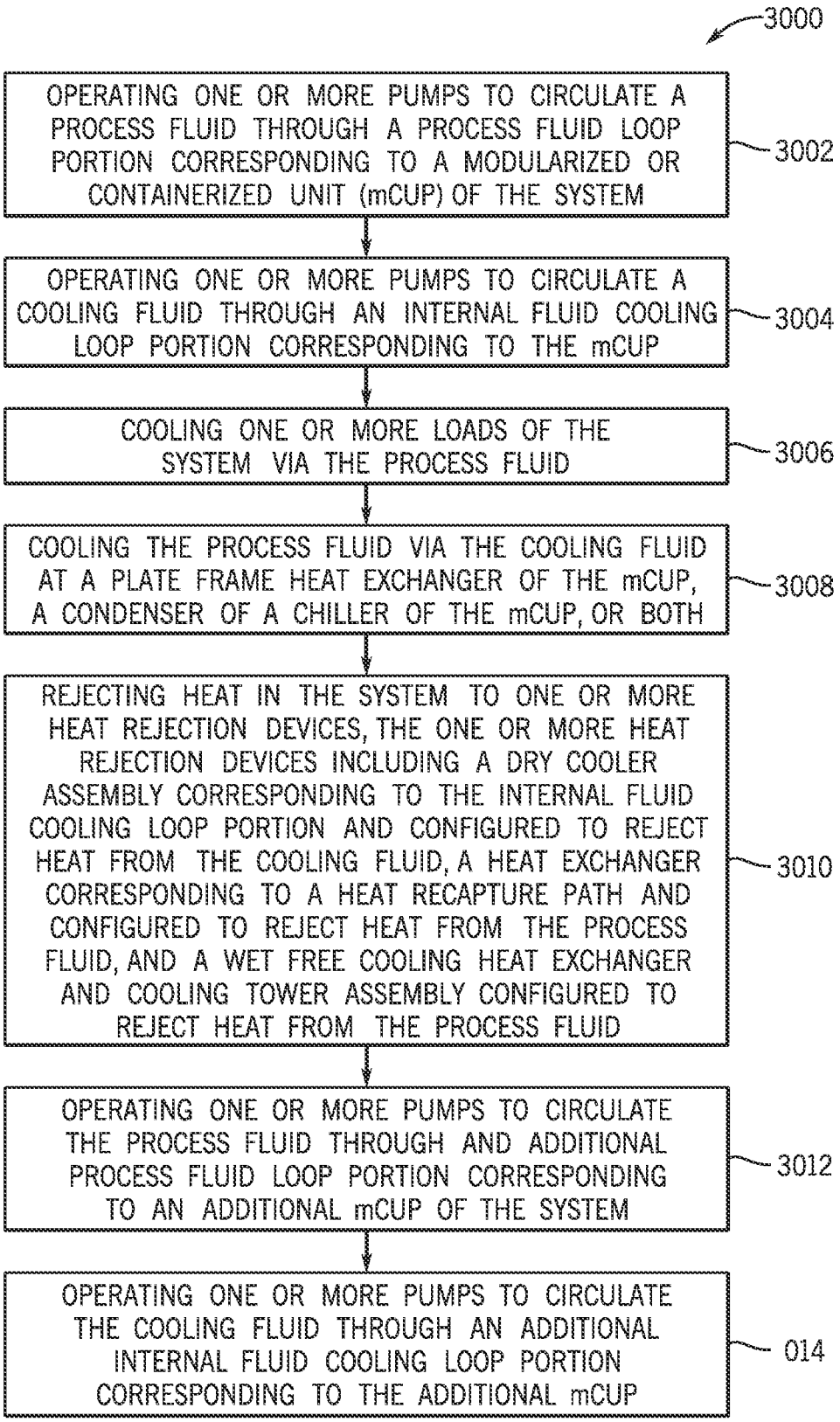
FIG. 11 is a process flow diagram illustrating a method of operating the system of FIG. 10, in accordance with an aspect of the present disclosure.

FIG. 11 is a process flow diagram illustrating an embodiment of a method 3000 of operating the system 2000 of FIG. 10. In the illustrated embodiment, the method 3000 includes operating (block 3002) one or more pumps to circulate a process fluid through a process fluid loop portion corresponding to a modularized or containerized unit (mCUP) of the system 2000. For example, the process fluid may be circulated between an evaporator of a vapor compression assembly (or chiller) of the mCUP, one or more loads of the system, and a plate frame heat exchanger of the mCUP, as described in detail above and below.

The method 3000 also includes operating (block 3004) one or more pumps to circulate a cooling fluid through an internal fluid cooling loop portion corresponding to the mCUP. For example, the internal fluid cooling loop portion may include a dry cooler assembly and circulate the cooling fluid between a condenser of the vapor compression assembly (or chiller) of the mCUP, the plate frame heat exchanger of the mCUP, or both. Bypass valves may be employed, as previously described, to cause the cooling fluid to bypass the condenser or the plate frame heat exchanger based on various conditions (e.g., ambient conditions, operating conditions, load/demand conditions, etc.). The method 3000 also includes cooling (block 3006) one or more loads of the system via the process fluid, and cooling (block 3008) the process fluid via the cooling fluid at the plate frame heat exchanger of the mCUP, via a refrigerant at the condenser of the vapor compression assembly (or chiller) of the mCUP, or both.

The method 3000 also includes rejecting heat (block 3010) in the system to one or more heat rejection devices not described above. Such one or more heat rejection devices may include, for example, a dry cooler assembly corresponding to the internal fluid cooling loop portion and configured to reject heat from the cooling fluid, a heat exchanger corresponding to a heat recapture path and configured to reject heat from the process fluid (e.g., to a heat recapture fluid), and a wet free cooling heat exchanger and cooling tower assembly configured to reject heat from the process fluid (e.g., to a fifth fluid).

The method 3000 also includes operating (block 3012) one or more pumps to circulate the process fluid through an additional process fluid loop portion corresponding to an additional mCUP of the system, and operating (block 3014) one or more pumps to circulate the cooling fluid through an additional internal fluid cooling loop portion corresponding to the additional mCUP. Detailed aspects of the additional mCUP are provided above with respect to FIG. 10. In general, the system includes at least the mCUP and the additional mCUP such that fluids and/or heat rejection devices are shared between the mCUP and the additional mCUP. It should be understood that more than two mCUPs may be employed in various embodiments of the present disclosure.

In general, presently disclosed systems and methods are configured to provide adequate cooling to one or more loads associated with an HVAC&R system, while improving energy efficiency over traditional embodiments, reducing refrigerant charge for vapor compression over traditional embodiments, and the like.

While only certain features of present embodiments have been illustrated and described herein, many modifications and changes will occur to those skilled in the art. It is, therefore, to be understood that the appended claims are intended to cover all such modifications and changes that fall within the true spirit of the disclosure. Further, it should be understood that certain elements of the disclosed embodiments may be combined or exchanged with one another.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, air conditioning, and/or refrigeration (HVAC&R) system, comprising:

a process fluid loop configured to receive a process fluid;

an internal fluid cooling loop configured to receive a cooling fluid;

an air cooled heat exchanger configured to cool the cooling fluid;

a vapor compression loop configured to receive a working fluid;

a condenser configured to place the cooling fluid and the working fluid in a first heat exchange relationship;

a heat exchanger configured to place the cooling fluid and the process fluid in a second heat exchange relationship, wherein the heat exchanger and the condenser are disposed in series relative to a flow of the cooling fluid through the internal fluid cooling loop;

a pump configured to bias the cooling fluid through the internal fluid cooling loop; and at least one controller configured to:

receive data indicative of a target return temperature of the process fluid from the load, or a target supply temperature of the process fluid to the load, or both; and control, based on the data, a pump setting of the pump, a fan setting of a fan of the air cooled heat exchanger, a first position of a first bypass valve disposed on the internal fluid cooling loop adjacent to the condenser, a second position of a second bypass valve disposed on the internal fluid cooling loop adjacent to the heat exchanger, or any combination thereof.

2. The HVAC&R system of claim 1, wherein the at least one controller is configured to control the pump setting of the pump based on the data.

3. The HVAC&R system of claim 1, comprising:

the first bypass valve disposed on the internal fluid cooling loop adjacent to the condenser; and the second bypass valve disposed on the internal fluid cooling loop adjacent to the heat exchanger, wherein the at least one controller is configured to control the first position of the first bypass valve based on the data, or control the second position of the second bypass valve based on the data, or both.

4. The HVAC&R system of claim 1, wherein the at least one controller is configured to control the fan setting of the fan of the air cooled heat exchanger based on the data.

5. The HVAC&R system of claim 1, comprising a sensor configured to detect an ambient dry bulb temperature, wherein the at least one controller configured to:

receive, from the sensor, additional data indicative of the ambient dry bulb temperature; and control, based on the additional data, the pump setting of the pump, the fan setting of the fan of the air cooled heat exchanger, the first position of the first bypass valve disposed on the internal fluid cooling loop adjacent to the condenser, the second position of the second bypass valve disposed on the internal fluid cooling loop adjacent the heat exchanger, or any combination thereof.

6. The HVAC&R system of claim 1, comprising a compressor disposed on the vapor compression loop, wherein the at least one controller configured to control a compressor setting of the compressor based on the data or additional data indicative of an ambient condition or an operating condition of the HVAC&R system.

7. The HVAC&R system of claim 1, comprising at least one controller configured to:

receive additional data indicative of an operating load or cooling demand of the load corresponding to the HVAC&R system; and control, based on the additional data, the pump setting of the pump, the fan setting of the fan of the air cooled heat exchanger, the first position of the first bypass valve disposed on the internal fluid cooling loop adjacent to the condenser, the second position of the second bypass valve disposed on the internal fluid cooling loop adjacent the heat exchanger, or any combination thereof.

8. The HVAC&R system of claim 1, wherein the at least one controller is configured to:

receive additional data indicative of a return temperature of the process fluid from the load corresponding to the HVAC&R system, or a supply temperature of the process fluid to the load, or both; and control, based on the additional data, the pump setting of the pump, the fan setting of the fan of the air cooled heat exchanger, the first position of the first bypass valve disposed on the internal fluid cooling loop adjacent to the condenser, the second position of the second bypass valve disposed on the internal fluid cooling loop adjacent the heat exchanger, or any combination thereof.

9. The HVAC&R system of claim 1, comprising an evaporator disposed on the vapor compression loop, wherein the evaporator is configured to place the process fluid and the working fluid in a third heat exchange relationship.

10. The HVAC&R system of claim 1, wherein the heat exchanger comprises a plate frame heat exchanger.

11. A heating, ventilation, air conditioning, and/or refrigeration (HVAC&R) system, comprising:

a process fluid loop configured to receive a process fluid;

an internal fluid cooling loop configured to receive a cooling fluid;

an air cooled heat exchanger configured to cool the cooling fluid;

a vapor compression assembly comprising a vapor compression loop configured to circulate a working fluid through a compressor, a condenser, an evaporator, and an expansion valve, wherein the condenser is configured to place the working fluid and the cooling fluid in a first heat exchange relationship;

a heat exchanger configured to place the cooling fluid and the process fluid in a second heat exchange relationship, wherein the heat exchanger and the condenser are disposed in series relative to a flow of the cooling fluid through the internal fluid cooling loop;

a pump configured to bias the cooling fluid through the internal fluid cooling loop;

a first bypass valve disposed on the internal fluid cooling loop adjacent to the heat exchanger;

a second bypass valve disposed on the internal fluid cooling loop adjacent to the condenser; and at least one controller configured to:

control the first bypass valve between a first open position and a first closed position based on an ambient condition, or any operating condition of the HVAC&R system, or both; and control the second bypass valve between a second open position and a second closed position based on the ambient condition, the operating condition, or both.

12. The HVAC&R system of claim 11, wherein the at least one controller is configured to control, based on the ambient condition, the operating condition, or both, a pump setting of the pump, a fan setting of a fan of the air cooled heat exchanger, a compressor setting of the compressor, or any combination thereof.

13. The HVAC&R system of claim 11, wherein the heat exchanger comprises a plate frame heat exchanger.

14. The HVAC&R system of claim 11, wherein the evaporator is configured to place the working fluid and the process fluid in a third heat exchange relationship.

15. The HVAC&R system of claim 11, wherein the process fluid loop is configured to circulate the process fluid to a load cooled by the HVAC&R system.

16. A heating, ventilation, air conditioning, and/or refrigeration (HVAC&R) system comprising:

a sensor system comprising one or more sensors, wherein the sensor system is configured to detect an ambient condition, or an operating condition of the HVAC&R system, or both; and a control system comprising one or more controllers, wherein the control system is configured to:

receive, from the sensor system, data indicative of the ambient condition, or the operating condition, or both; and control, based on the data, a first pump speed of a first pump configured to bias a cooling fluid through an internal fluid cooling loop comprising an air cooled heat exchanger and extending between a condenser of a vapor compression assembly of the HVAC&R system and a heat exchanger of the HVAC&R system; and control, based on the data, a second pump speed of a second pump configured to bias a process fluid through a process fluid loop comprising a load conditioned by the process fluid and extending between an evaporator of the vapor compression assembly and the heat exchanger.

17. The HVAC&R system of claim 16, wherein the control system is configured to control, based on the data, a fan setting of a fan of the air cooled heat exchanger.

18. The HVAC&R system of claim 16, wherein the control system is configured to control, based on the data, a bypass valve disposed on the internal fluid cooling loop adjacent to the heat exchanger between an open position and a closed position.

19. The HVAC&R system of claim 16, wherein the control system is configured to control, based on the data, a bypass valve disposed on the internal fluid cooling loop adjacent to the condenser between an open position and a closed position.

20. The HVAC&R system of claim 16, wherein the control system is configured to control, based on the data, a compressor setting of a compressor of the vapor compression assembly.

* * * * *